343-700 MS AU 254 EX
8/31/82 OR 4,347,516

United States Patent [19]

Shrekenhamer

[11] 4,347,516

[45] Aug. 31, 1982

[54] RECTANGULAR BEAM SHAPING ANTENNA EMPLOYING MICROSTRIP RADIATORS

[75] Inventor: Abraham Shrekenhamer, Wharton, N.J.

[73] Assignee: The Singer Company, Little Falls, N.J.

[21] Appl. No.: 167,285

[22] Filed: Jul. 9, 1980

[51] Int. Cl.[3] ..... H01Q 1/28; H01Q 3/24

[52] U.S. Cl. ..... 343/700 MS; 343/705; 343/737

[58] Field of Search ..... 343/700 MS, 771, 705, 343/737, 853

[56] References Cited

U.S. PATENT DOCUMENTS 4,180,817 12/1979 Sanford ..... 343/700 MS
4,180,818 12/1979 Schwartz ..... 343/700 MS

*Primary Examiner*—Eli Lieberman
*Attorney, Agent, or Firm*—John C. Altmiller; Thomas W. Kennedy

[57] ABSTRACT

To provide improved performance in a microwave antenna, particularly for use in a Doppler navigation system, rectangular arrays obtained from truncated slanted arrays are used to obtain beam shapes which exhibit a high degree of independence from over-water shifts.

8 Claims, 45 Drawing Figures

RECTANGULAR APERTURE PATTERN IN A GAMMA-SIGMA COORDINATE SYSTEM

SLANTED APERTURE PATTERN IN A GAMMA-ZETA COORDINATE SYSTEM

SLANTED APERTURE PATTERN IN A GAMMA-SIGMA COORDINATE SYSTEM

IDEAL GAMMA-PSI PATTERN IN GAMMA-SIGMA COORDINATES

CONTOUR ROTATION EFFECTS
RESULTING FROM APERTURE TRUNCATION

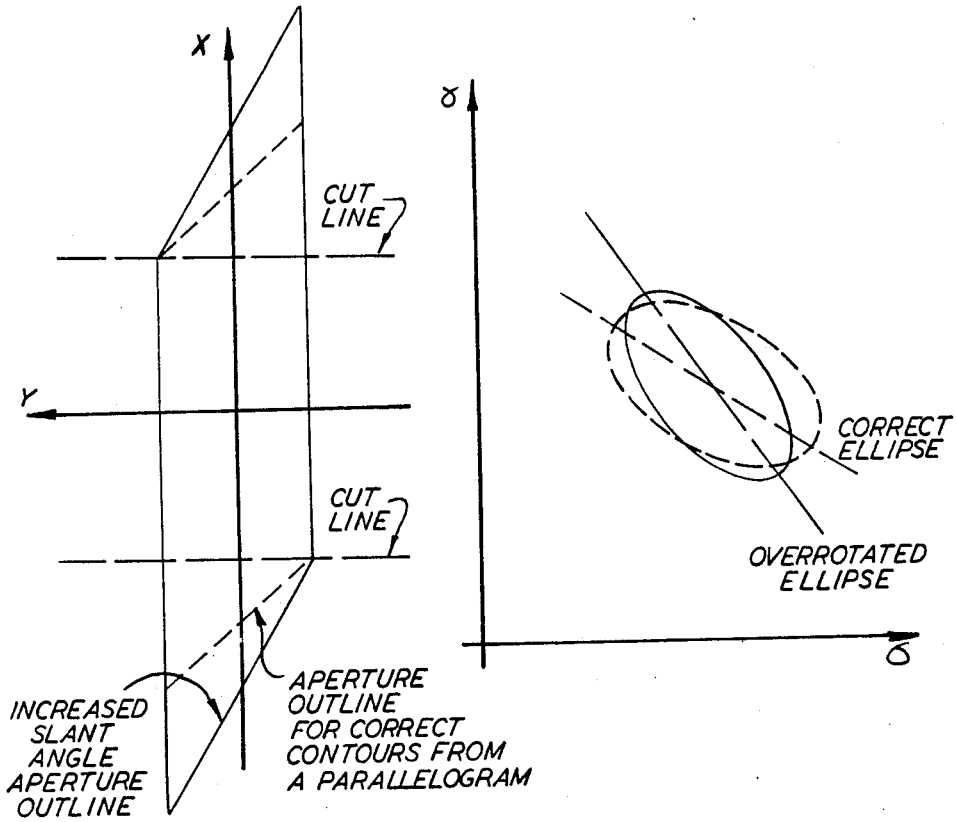
OVERROTATION OF CONTOUR-ELLIPSE AXIS BY A LARGE SLANT ANGLE
FIG. 7a
FIG. 7b
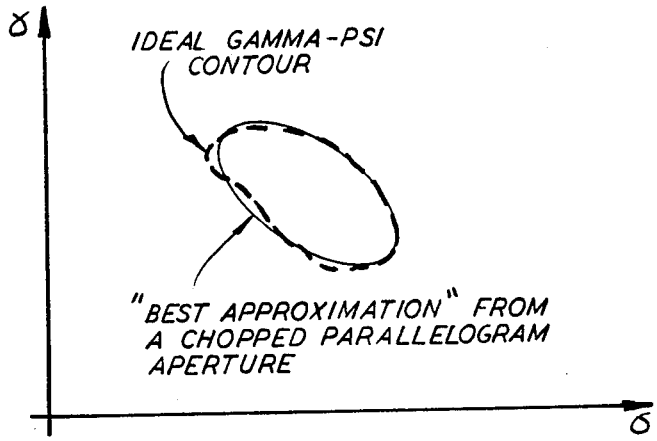

FORWARD FIRING ARRAY FED FROM LEFT

BACKWARD FIRING ARRAY FED FROM RIGHT

COMBINED AMPLITUDE FUNCTION FROM a & b

AMPLITUDE FUNCTION IN THE PLANE OF THE FEED ARRAY (SUMMED ALONG THE RADIATING ARRAYS), WHEN FED FROM LEFT (PORT A).

AMPLITUDE FUNCTION IN THE PLANE OF THE RADIATING ARRAYS, (SUMMED ACROSS THE APERTURE), WHEN FED FROM TOP (PORT A).

BEAM GROUND FOOTPRINT SHOWING DIRECTION OF MOTION WITH INCREASING FREQUENCY

PRINCIPAL SIGMA PLANE FAR FIELD PATTERN

SHAPED MAIN BEAM POWER CONTOURS IN GAMMA-BETA COORDINATES

VERTICALLY POLARIZED

HORIZONTALLY POLARIZED

AMPLITUDE FUNCTION IN THE PLANE OF THE FEED ARRAY (SUMMED ALONG THE RADIATING ARRAYS), WHEN FED FROM LEFT (PORT A OR E)

AMPLITUDE FUNCTION IN THE H-PLANE OF THE RADIATING ARRAYS (SUMMED ACROSS THE APERTURE), WHEN FED FROM TOP (PORT A OR E)

PRINCIPAL GAMMA PLANE FAR FIELD PATTERN

PRINCIPAL SIGMA PLANE FAR FIELD PATTERN

SHAPED MAIN BEAM POWER CONTOURS IN GAMMA-BETA COORDINATES

RECTANGULAR BEAM SHAPING ANTENNA EMPLOYING MICROSTRIP RADIATORS

BACKGROUND OF THE INVENTION

This invention relates to microwave antennas in general and more particularly to an improved microwave antenna for use in Doppler navigation systems.

A common problem in Doppler navigation antennas is what is known as over-water shift. Because of the different characteristics of returned energy from land and water in the typical Doppler system, a shift occurs when flying over water which can lead to a considerable velocity error. One manner of overcoming this is what is known as a beam lobing technique in which each of the Doppler beams are alternated between two positions, a few degrees apart. Although such an approach has been found workable, it requires additional hardware and additional time.

Another approach is that disclosed in U.S. Pat. No. 2,983,920 granted to R. H. Rearwin and assigned to the same assignee as the present invention. Disclosed therein is a planar array of micro-wave antennas which are slanted at 45° to permit generating a beam shape which exhibits a high degree of independence from over-water shift. However, the implementation disclosed therein is not particularly practical. U.S. Pat. No. 4,180,818, discloses the use of forward and backward firing slanted arrays to achieve frequency compensation. However, the use of slanted arrays creates other problems. Typically an antenna aperture is bounded in a rectangular area. When a slanted antenna aperture is fitted into such a rectangular area, substantial areas of the rectangular area will not contain radiating elements. Thus the effective area and gain of the antenna are smaller than if the entire rectangular area were used.

The present invention solves the problems in the prior art by providing a rectangular antenna aperture which generates an antenna pattern very similar to the slanted aperture antenna. Thus the antenna of the present invention realizes the objectives of reducing over-water shifts and achieving frequency compensation while using the entire rectangular mounting area.

BRIEF DESCRIPTION OF THE DRAWINGS

FIG. 7*a* illustrates the effect of overrotation by means of an increased slant angle.

FIG. 7*b* shows the contour resulting from the truncation of the aperture in FIG. 7*a*.

DETAILED DESCRIPTION OF THE INVENTION

Figure 1A:
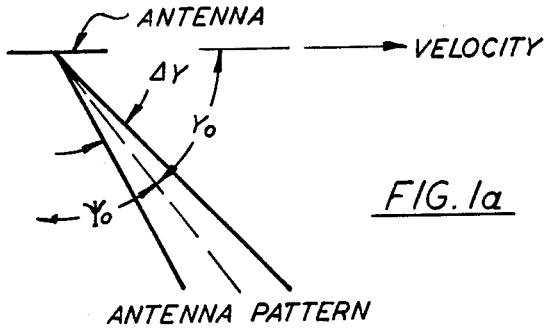
FIG. 1*a* is a diagram showing a typical antenna radiation pattern.
Figure 1B:
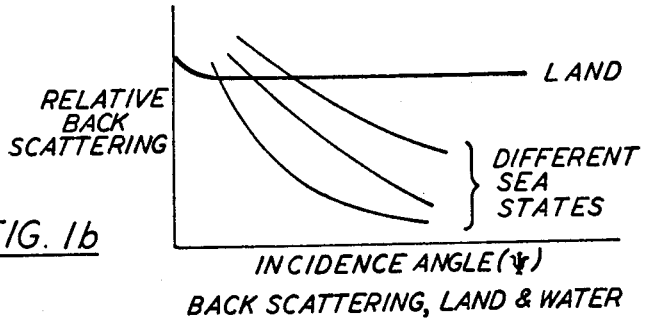
FIG. 1*b* illustrates typically back scattering functions.
Figure 1C:
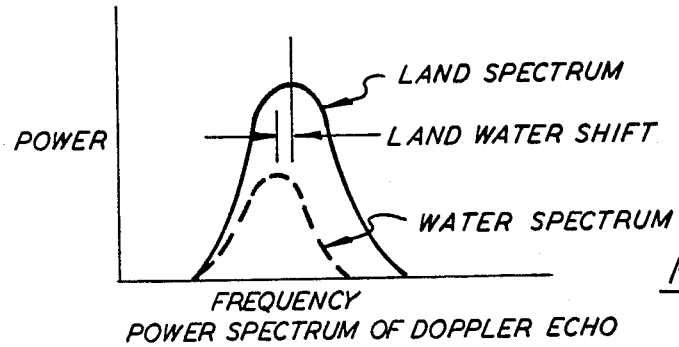
FIG. 1*c* is a further diagram showing the effect of land-water shift.

Regardless of the technique used to track the Doppler echo, all Doppler radars will experience a land-water shift unless specific effort is taken in the design to eliminate this shift. To discuss the mechanism of the land-water shift, consider a simple single-beam system where $\gamma_o$ (the angle between the velocity vector and the center of the radiated beam) and $\psi_o$ (the incidence angle of the beam on to the scattering surface) are in the same plane and are complementary, as shown in FIG. 1*a*. The antenna beam width is labeled $\Delta\gamma$. Over land, the uniform backscattering (FIG. 1*b*) results in a spectrum whose center is a function of $\gamma_o$ and whose width is a function of $\Delta\gamma$ (FIG. 1*c*). When flying over water, the back-scattering is non-uniform as shown in FIG. 1*b* with the large $\psi$ angles (small $\gamma$ angles) having a lower scattering coefficient. Since the smaller $\gamma$ angles are associated with the higher frequencies of the Doppler spectrum, the latter are attenuated with respect to the lower frequencies thereby shifting the spectrum peak to a lower frequency. The land-water shift generally is from 1 percent to 3 percent depending on the antenna parameters.

Figure 2:
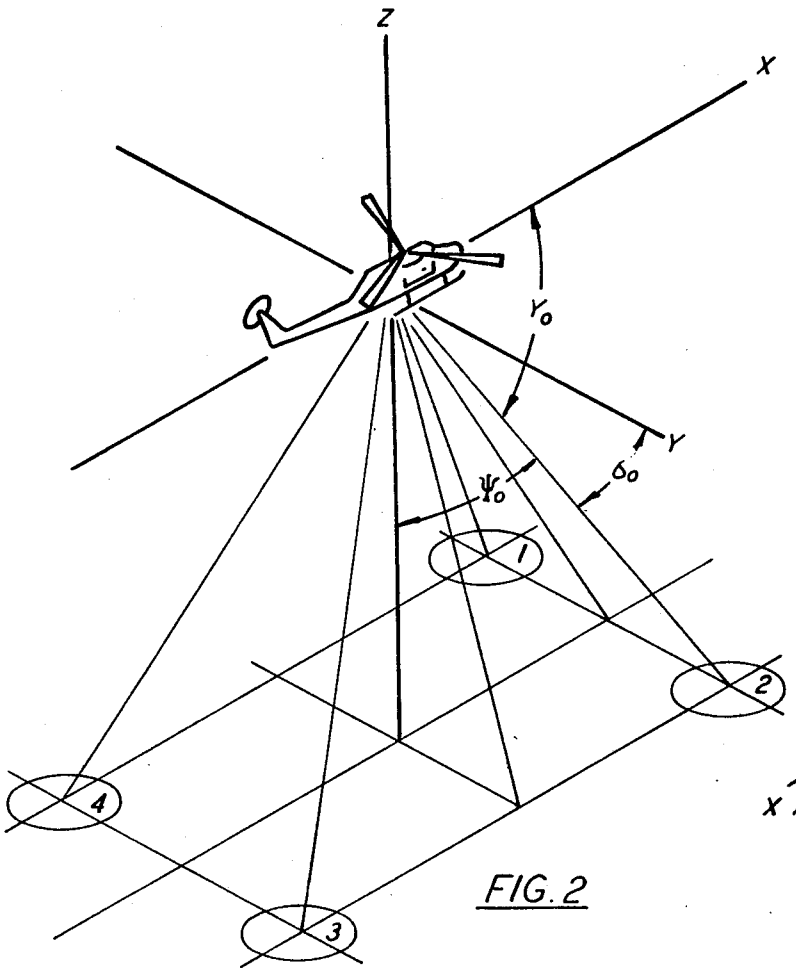
FIG. 2 is a diagram showing four slanted beams radiated from two antenna apertures.

The three-dimensional situation is more complicated. Assume an aircraft is traveling along axis X in FIG. 2. Axis Y is horizontal and orthogonal to axis X, while axis Z is vertical. Rectangular arrays generate four beams at an angle to these axes. The axis of any one of these beams (e.g., beam 2) is at an angle $\gamma_o$ to the X-axis, at an angle $\sigma_o$ to the Y axis, and at an angle $\psi_o$ to the Z axis. A conventional rectangular antenna, shown in FIG. 3*a*, has an amplitude function A which can be described as a product of two separate functions on the X axis and Y axis. Thus:

$$A(x,y)=f(x)\quad g(y)$$

The antenna pattern for a conventional rectangular antenna is therefore said to be "separable" in $\gamma$ and $\sigma$. Since the scattering coefficient over water varies with angle, it is desirable to have an antenna pattern which is separable in $\gamma$ and $\psi$ instead of $\gamma$ and $\sigma$. This type of antenna pattern would largely eliminate the land-water shift.

Figure 3A:
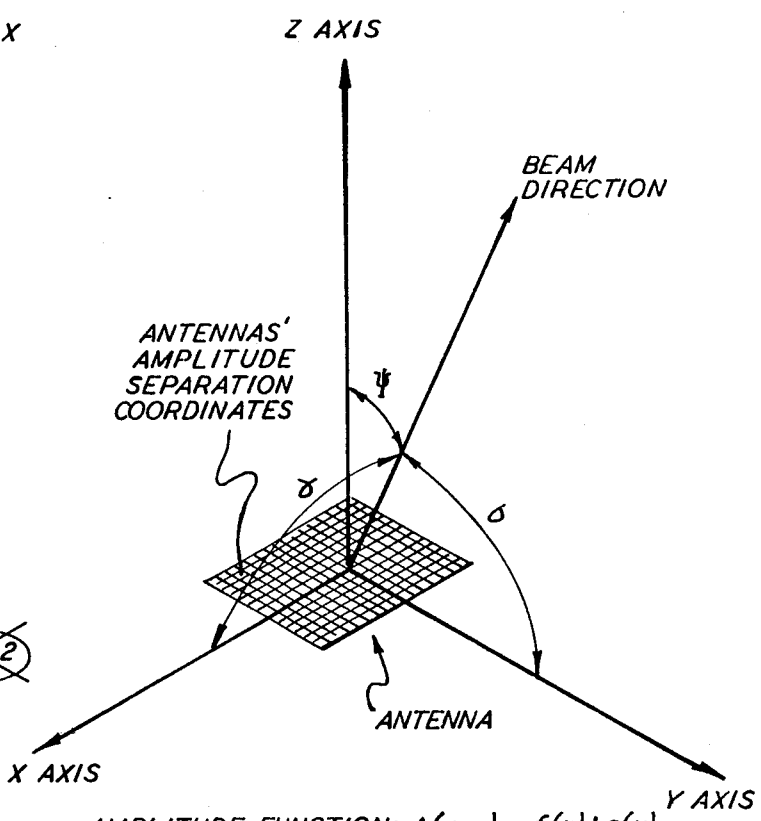
FIG. 3*a* is a diagram of a coordinate system for a conventional rectangular antenna.
Figure 3C:
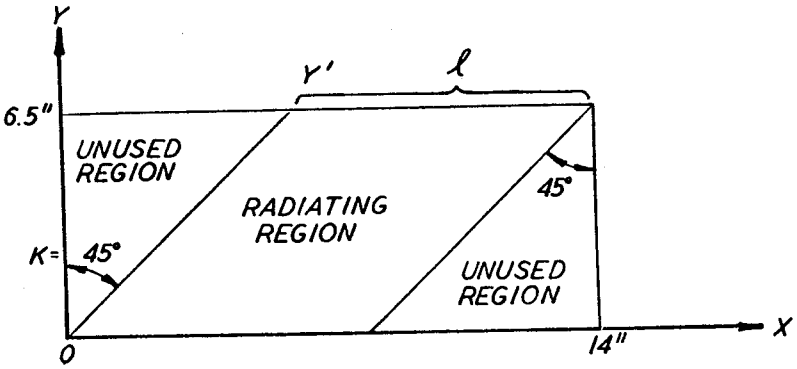
FIG. 3*c* is a diagram of a slanted aperture antenna with a slant angle of 45°.
Figure 3B:
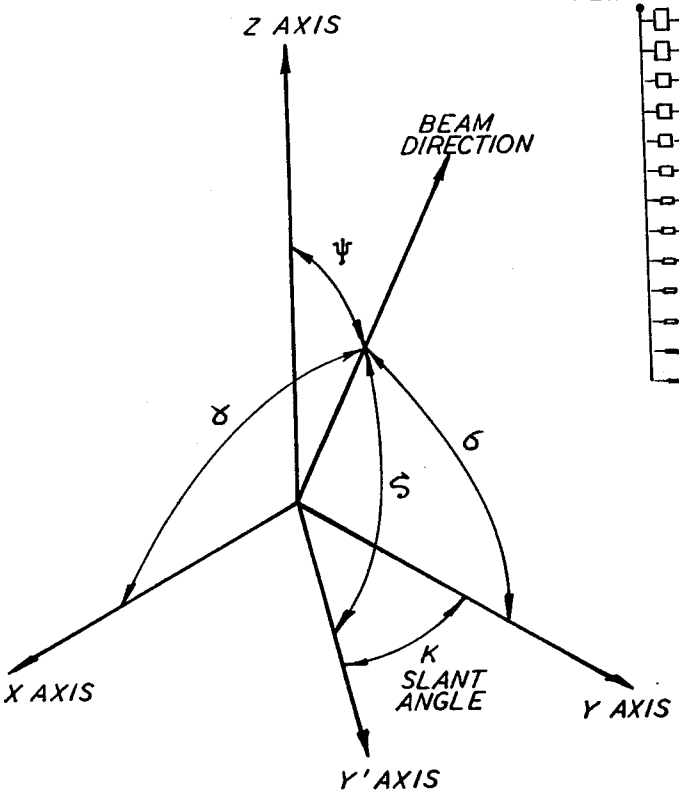
FIG. 3*b* is a diagram of a slanted axis coordinate system.

FIG. 3*b* shows a slanted-axis coordinate system intended to achieve an antenna pattern separable in $\psi$ and $\gamma$. The $Y^1$ axis is a projection of the beam axis onto the X-Y plane. The $Y^1$ axis is at angle $\kappa$ to the Y axis.

FIG. 3*c* shows a slanted aperture antenna with a slant angle of $\kappa=45°$. The amplitude function for this antenna is a product of two separate functions on the X axis and $Y^1$ axis.

$$A(x,y^1)=f^1(x)\quad g^1(y^1)$$

The antenna pattern for the slanted aperture antenna is separable in $\gamma$ and $\zeta$, where $\zeta$ is the angle between the $Y^1$ axis and the beam axis. Near the center of the beam, the antenna pattern is also separable (to a close approximation) in $\gamma$ and $\psi$, and is thus largely independent of the land-water shift. However, FIG. 3*c* also shows that the slanted aperture antenna leaves substantial parts of the rectangular mounting area unused. Thus the gain for the slanted aperture antenna is lower than if the entire rectangular area contained radiating elements. Furthermore, the shortness of the radiating arrays in the slanted array antenna limits the number of radiating elements in each array, which can produce an unacceptably low insertion loss.

The present invention solves these problems by using a rectangular antenna aperture which produces a slanted amplitude function.

Figure 4:
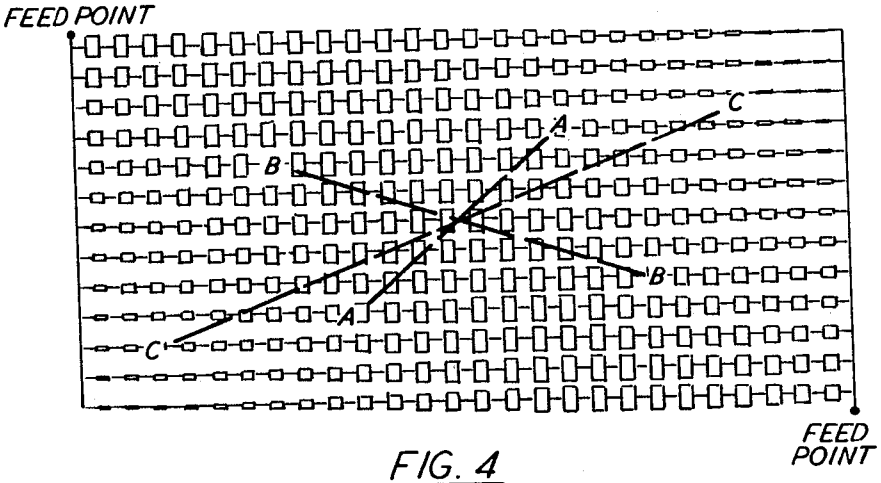
FIG. 4 shows the arrangement of radiating elements in one embodiment of the present invention.

In a slanted array antenna, such as shown in FIG. 4 of U.S. Pat. No. 4,180,818 each array has the same arrangement of radiating elements. The arrays are shifted with respect to each other along the X axis. By contrast, the rectangular antenna aperture of the present invention shown in FIG. 4 contains arrays with differing arrangements of radiating elements. In FIG. 4 the radiating elements are microstrip patches. Essentially these arrays are derived by truncating the edges of a long slanted aperture antenna.

The antenna of FIG. 4 is obtained from a long slanted array which is truncated to form a rectangular array. The truncation of the edges of the slanted array necessitates changes in the radiating elements in order to maintain the separability of the antenna pattern in a slanted coordinate system. Computer analysis revealed that a change in the slant angle of the antenna amplitude distribution could compensate for the truncation of the edges of the antenna.

The concept of this antenna is illustrated as follows: The simple rectangular antenna will produce a beam shape that is an ellipse with its axes paralled to the angular coordinate axes $\gamma$ and $\sigma$ (FIG. 5*a*), thus maintaining the $\gamma$–$\sigma$ pattern separability. A parallelogram aperture, on the other hand, will produce an ellipse with its axes parallel to the $\gamma$–$\zeta$ angular axes (FIG. 5*b*), which would appear as a rotation ellipse, after mapping into the $\gamma$–$\sigma$ angular coordinate system (FIG. 5*c*), closely resembling the contour shape for the ideal $\gamma$–$\psi$ antenna (FIG. 5*d*). It follows that the amount of contour rotation in the parallelogram-produced beam is dependent on the parallelogram angle, or in other words, its deviation from the rectangular shape.

Figure 5A:
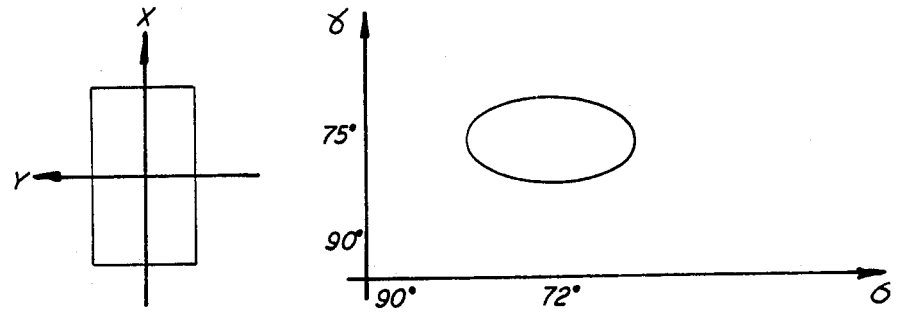
FIG. 5*a* illustrates the Gamma-Sigma pattern of a rectangular aperture antenna array.
Figure 5B:
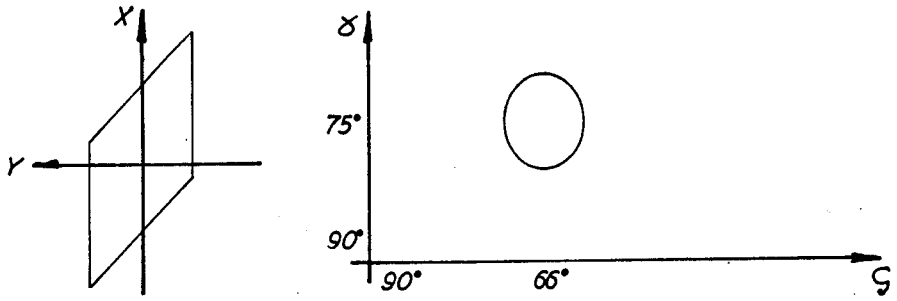
FIG. 5*b* illustrates the Gamma-Zeta pattern of a slanted aperture array.
Figure 5C:
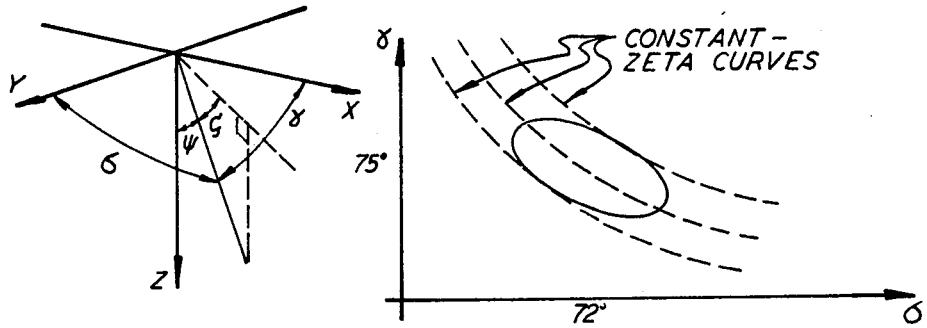
FIG. 5*c* shows the slanted aperture pattern in Gamma-Sigma coordinates.
Figure 5D:
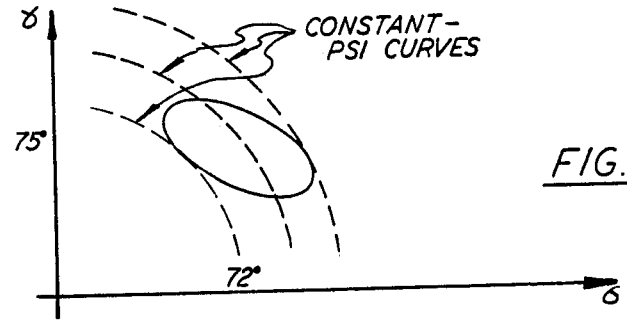
FIG. 5*d* shows the ideal Gamma-Psi pattern in Gamma-Sigma coordinates.

If a parallelogram aperture is taken and its edges truncated as shown in FIG. 5*a*, the effect will be a rotation of the beam contour elliplse back towards the rectangular aperture's beam contour orientation (FIG. 5*b*). The amount of that rotation depends on the amplitude function used on the parallelogram aperture before edge truncation. For example, if a uniform amplitude function were used, then the truncation would form a simple rectangular uniformly illuminated aperture and the resultant rotation will be maximal, that is, the beam contour ellipse will change from a $\gamma$–$\zeta$ axis separability to $\gamma$–$\sigma$ axis separability. If, on the other hand, the amplitude function is highly tapered on edges, then the truncation of the edges will have a smaller effect on the slanted character of the amplitude distribution and the rotation of the beam contour ellipse towards the $\gamma$–$\sigma$ axes will be lesser. Thus, it is possible generate slanted beam contours from a rectangular aperture through the use of tapered amplitude functions on slanted axes.

By selecting an amplitude slant angle larger than would be optimum for a parallelogram aperture, it is possible to compensate for the beam contour tile error produced by the loss of edges when the rectangular aperture is formed from the parallelogram. The larger slant angle produces an over-rotation of the beam-contour (FIG. 7*a*), and since the truncation produces an opposite effect, it should be possible to produce an approximation of the ideal $\gamma$–$\psi$ beam contours by a judicious use of slant angles and amplitude functions, which are interactive now in regard to their effect on beam contour alignment (FIG. 7*b*).

It should be remembered that the choice of amplitude functions that may be used will depend on system requirements as far as beamwidths, gain and slidelobe levels are concerned. It is thus reasonable to assume that a wide range of tapered amplitude functions will be considered, depending on the application. The amount of over-compensation through amplitude slant-angle increase will thus be dependent on system requirements and will have to be tailored in each case.

Figure 8:
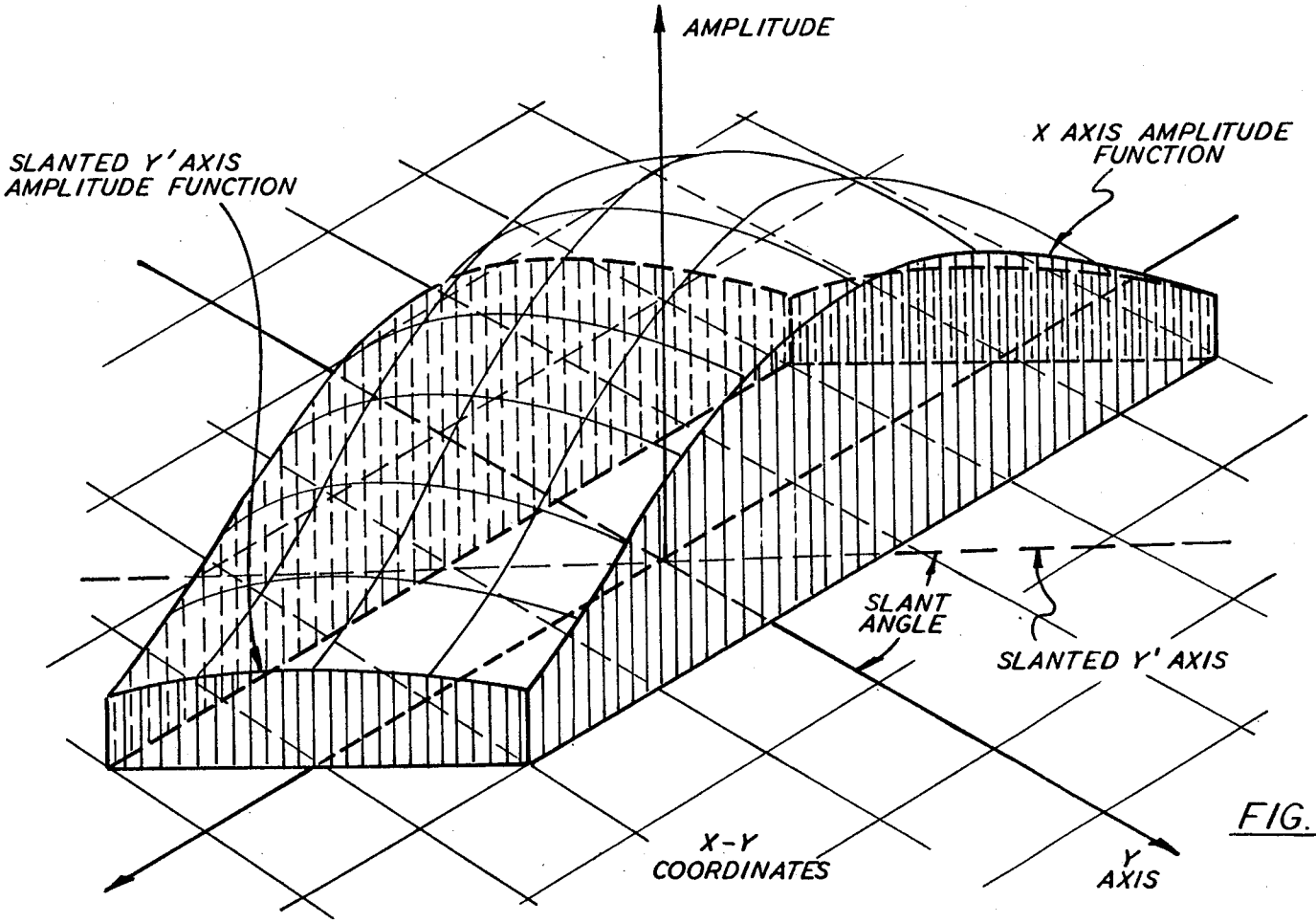
FIG. 8 shows the amplitude distribution on a typical baseline parallelogram aperture.

The process of antenna design is an iterative one, which starts with a long parallelogram aperture with a tapered amplitude distribution as shown in FIG. 8. The slant angle of the parallelogram is of an arbitrary value, say 45°. The dimensions are selected so that the required rectangular aperture can be confined by the parallelogram. In next step, the slanted amplitude function is assigned to the rectangular domain from the parallelogram domain by the intersection of both domains. In the next step the far field patterns and beam contours are computed and evaluated against system requirements and $\gamma$-$\psi$ contours. A manipulation of amplitude functions controls the beamwidths and slidelobe levels, and a new slant angle is selected to bring the beam contours into a better approximation to $\gamma$-$\psi$ contours. The process is now repeated over and over with new starting parallelogram functions until the requirements are satisfied.

Once a satisfactory amplitude distribution has been obtained for the rectangular aperture, the next step is to select the means of realizing it. A variety of radiators may be used in conjunction with a variety of feeding schemes. One of the methods that can be applied here is that of traveling wave radiating arrays filling the rectangular aperture. These arrays may then be fed by either a traveling wave feed array or a corporate feed array. The subject of traveling wave array design to realize a prescribed amplitude function has been already treated extensively in the literature and will not be repeated here.

Figure 9:
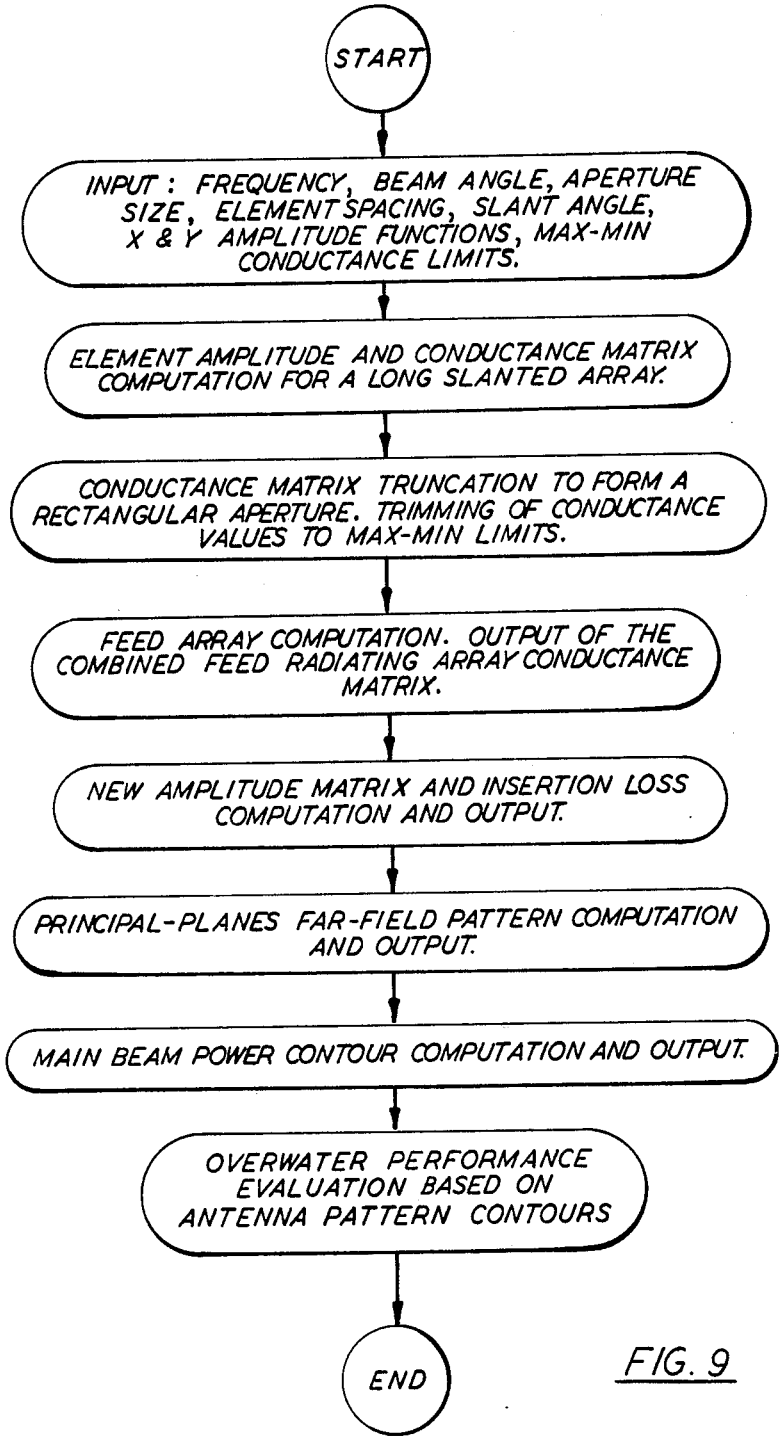
FIG. 9 is a flow chart illustrating the steps of obtaining an antenna design according to the present invention.
Figure 10:
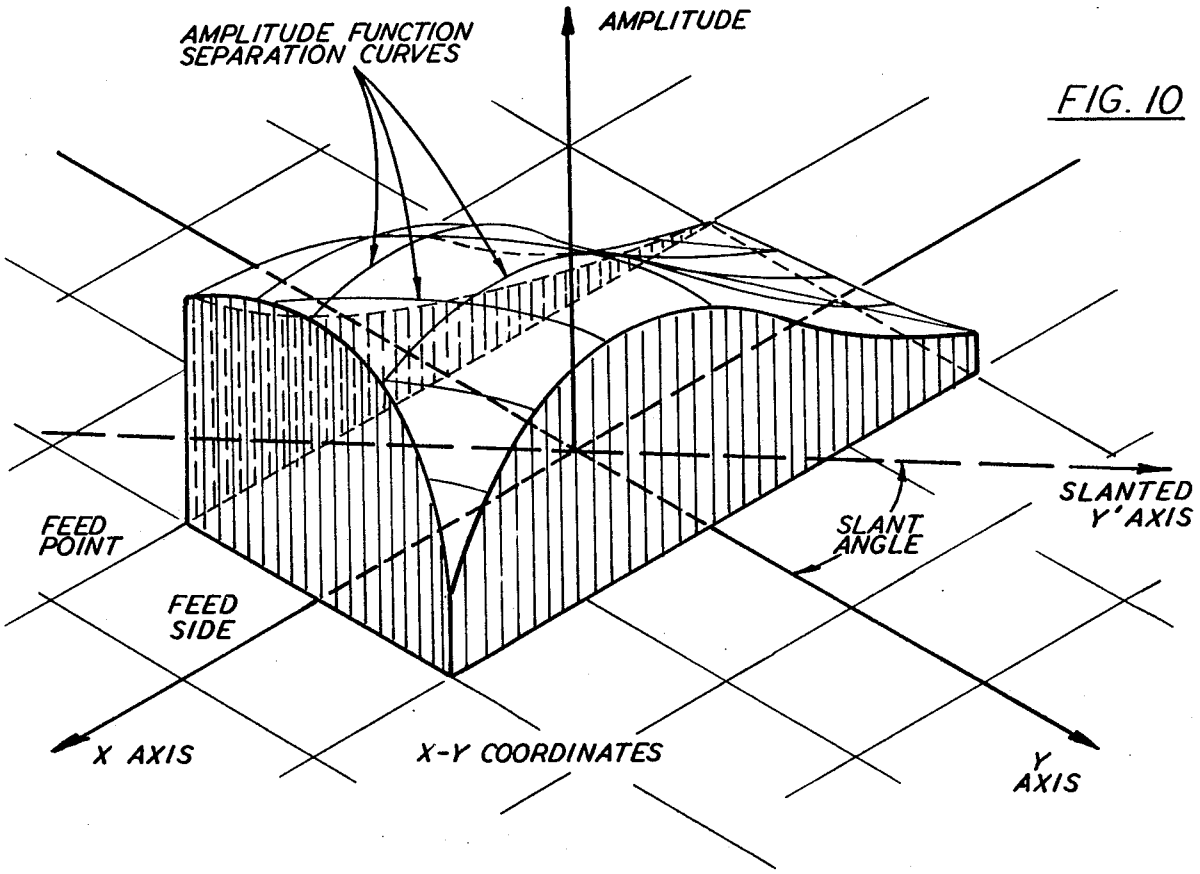
FIG. 10 illustrates the amplitude distribution for a two-beam symmetrical antenna when fed from one port.

When a requirement exists that a single aperture should generate two beams from two input ports, with two beams of identical specifications and symmetrically located, a symmetry requirement is imposed on the radiating and feed arrays. In the case of the rectangular antenna with a slanted amplitude function, the symmetry is an odd symmetry in the slanted coordinate system with its origin at the apertures center (FIG. 5*a*). In this case the prescribed amplitude function can exist over one half of the aperture only, with the amplitude or the remaining half subject to the radiating coefficients which were made symmetrical to the first half. This alteration of amplitude distribution necessitates the inclusion of this design step (i.e. the determination of radiating and coupling coefficients) in the initial iterative loop that seeks to optimize slant angle and amplitude distribution. FIG. 9 shows the logical design flow chart. A typical amplitude distribution for a two-beam aperture is depicted in FIG. 10.

It is necessary for the conductances of the elements to be symmetrical about the axis C in FIG. 5*a* since each array generates both a forward slanted beam and a backward slanted beam.

Figure 11:
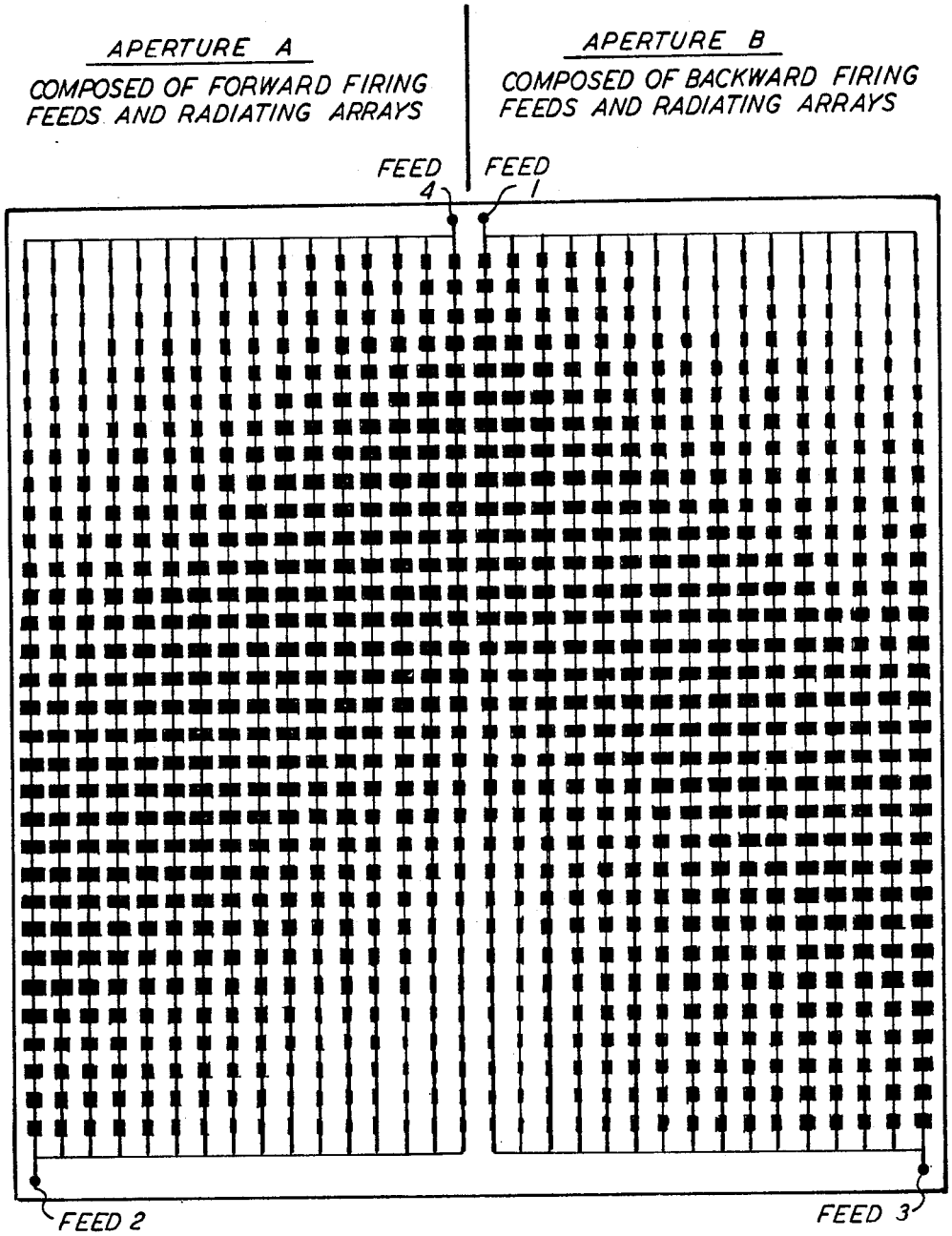
FIG. 11 is a plan view of an antenna in accordance with the present invention showing forward firing and backward firing antenna arrays.
Figure 13:
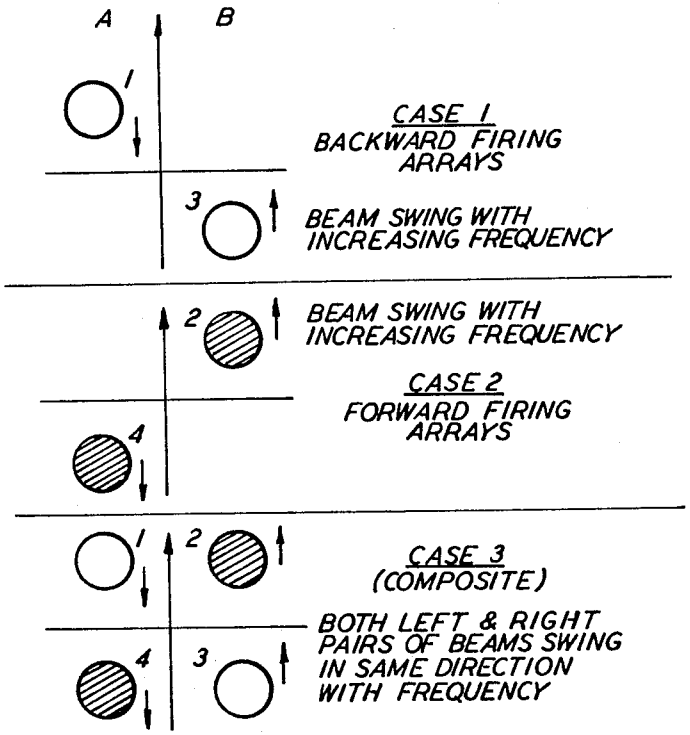
FIG. 13 shows how the shifting of the four antenna beams compensates for frequency changes.
Figure 12:
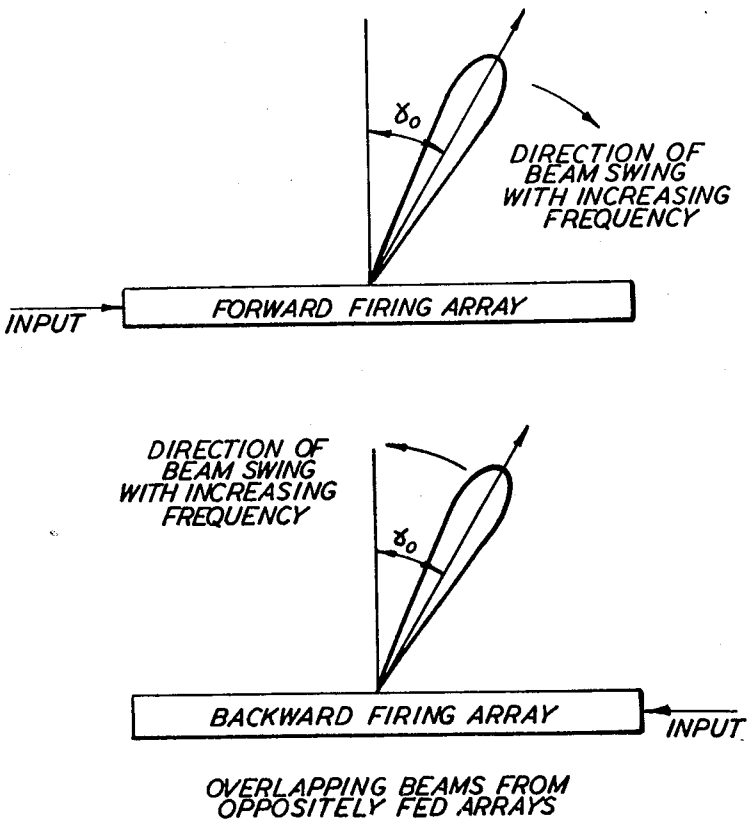
FIG. 12 shows the shift in beam angle of the forward and backward firing arrays with increasing frequency.

In actual operation, two of the antenna apertures are used together, as shown in FIG. 11. Apertures A and B generate four slanted beams. Aperture A contains forward firing feeds and arrays. One feed (feed 4) is at the front of the aperture and the other feed (feed 2) is at the rear of the aperture. The beams produced by this aperture will point in the same direction as the input feed, as shown in FIG. 12. Furthermore, the beam will slant forward more as antenna frequency increases. On the other hand, aperture B contains backward firing feeds and arrays. One feed (feed 1) is at the front of the aperture and the other feed (feed 3) is at the rear of the aperture. The beams produced by this aperture will point in the opposite direction to the input feed, as shown in FIG. 12. The beam will slant backward less an antenna frequency increases. FIG. 13 shows the pattern of four beams generated by the two apertures. It is evident that as antenna frequency changes, the included angle between beams on any one side of the antenna (e.g., beams 1 and 4) remains virtually constant. Thus the arrangement of antenna beams compensates for shifts in antenna frequency.

The antenna just described, although obtaining the necessary beam shaping, frequency and temperature independence while still requires two apertures in order to generate four beams. The antenna of FIG. 14 generates four beams in a form suitable for Doppler navagation from the same aperture allowing the narrowest beam widths from a given total antenna area.

Figure 14:
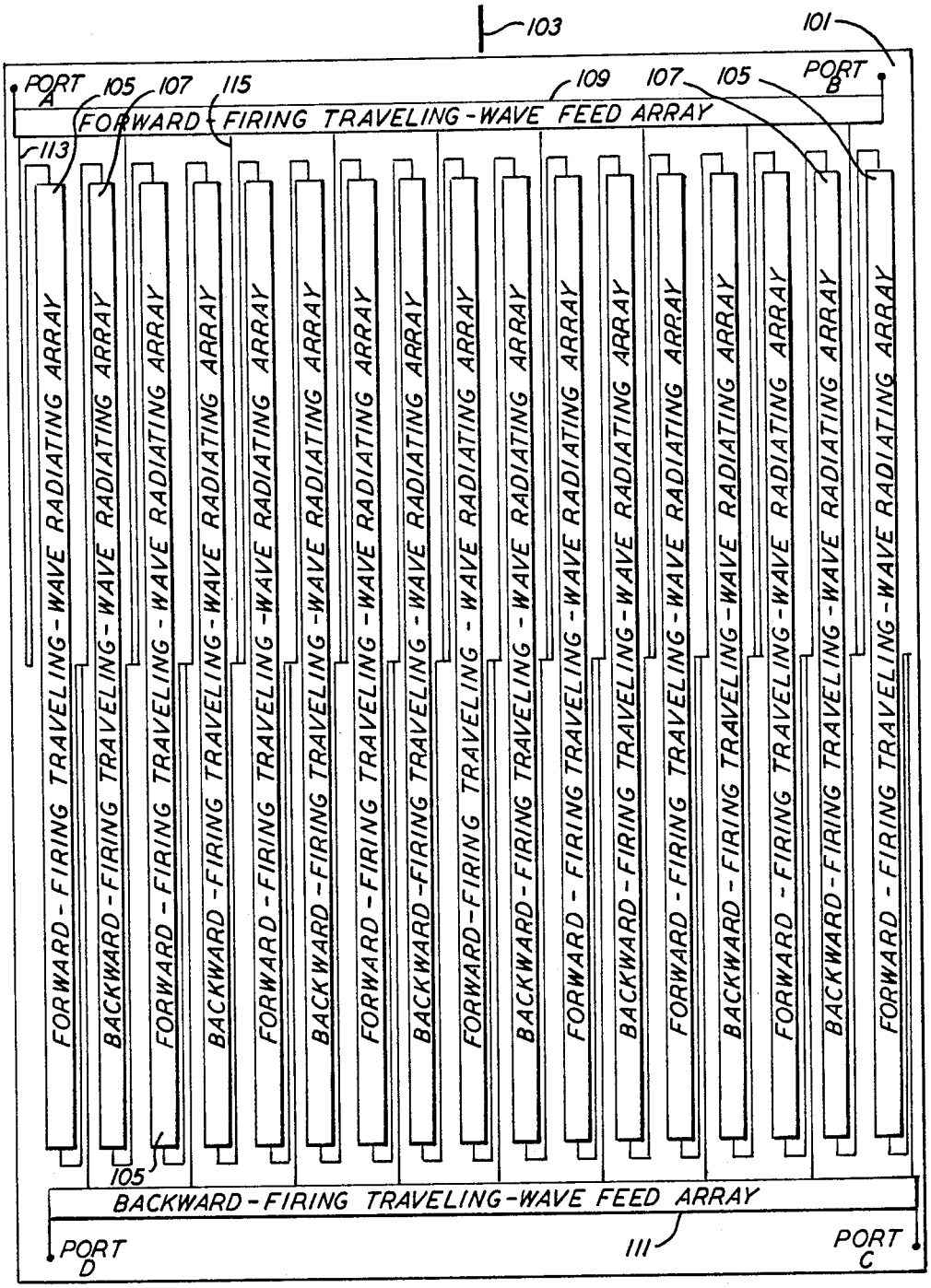
FIG. 14 is a plan view of an antenna array layout for a four beam single aperture antenna.

As illustrated by FIG. 14 the antenna includes a single radiating aperture. The radiator portion of the aperture comprises a plurality of forward and backward linear radiating arrays interlaced together and parallel to the longitudinal axis 103. As illustrated, forward travelling arrays 105 alternate with backward firing travelling arrays 107. The arrays are fed by two travelling wave feed arrays 109 and 111. Array 109 is a forward firing travelling wave feed array. The feed arrays are connected to the radiating arrays by means of transmission lines such that alternate forward and backward firing arrays are fed at opposite ends. For example, if port A is excited, all odd number arrays, i.e., forward firing arrays 105, are fed from the top. All even arrays, i.e., the backward firing arrays 107, are fed from the bottom. Thus, there is a transmission line 113 from the array 109 which feeds into the top of the left most foward firing array 105. Similarly, transmission line 115 feeds into the top of the third array, i.e., the second forward firing array 105, and also feeds into the bottom of the second array, i.e., the first backward firing travelling wave radiating array 107. This pattern is repeated across the antenna.

Figure 15:
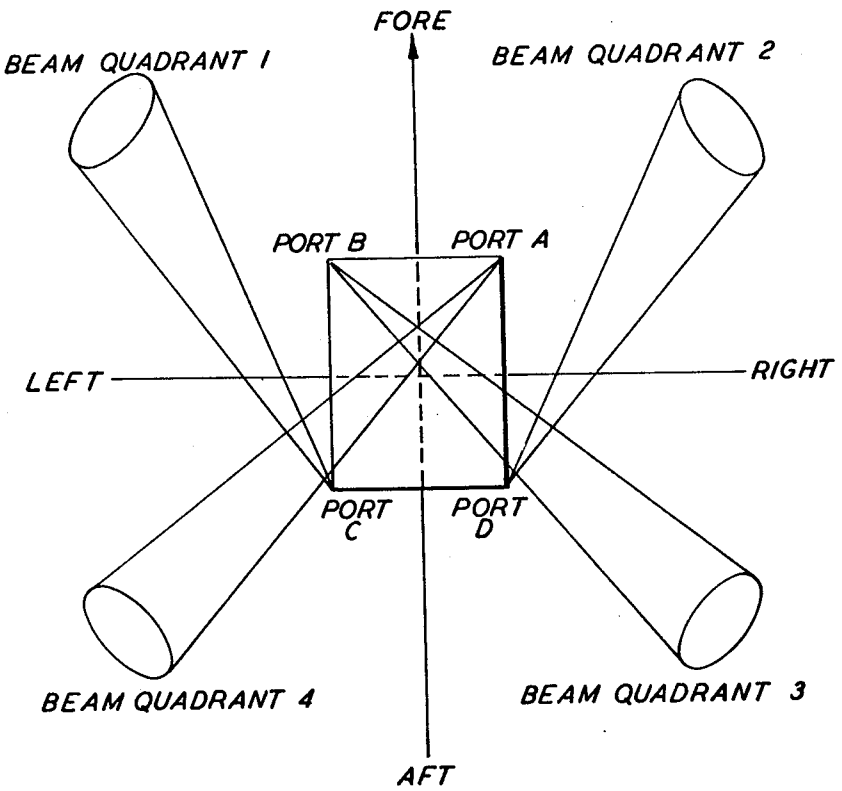
FIG. 15 illustrates the feed port to beam direction correspondence of the antenna of FIG. 14.
Figure 16A:
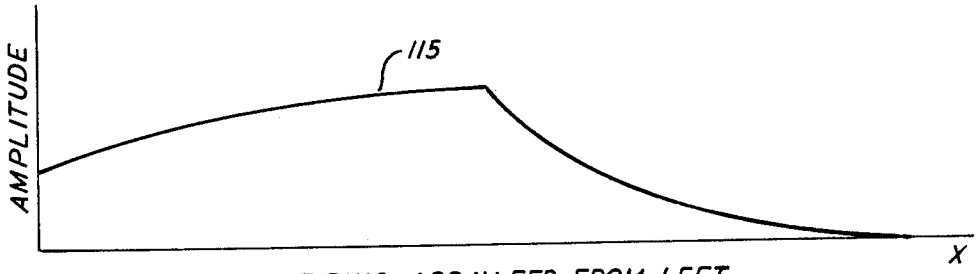
FIGS. 16*a*–16*c* illustrate amplitude functions of the antenna of FIG. 14.
Figure 16B:
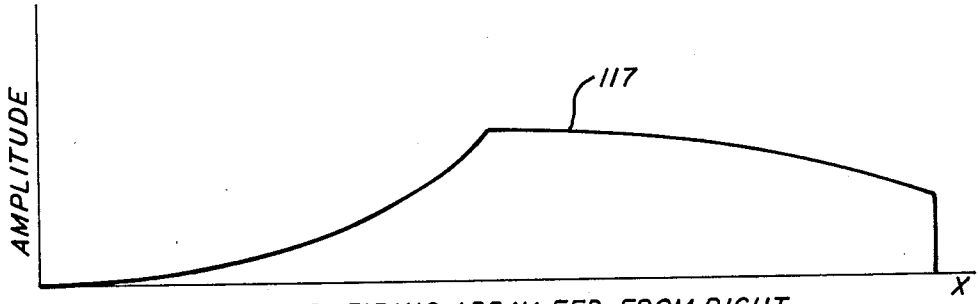
Figure 16C:
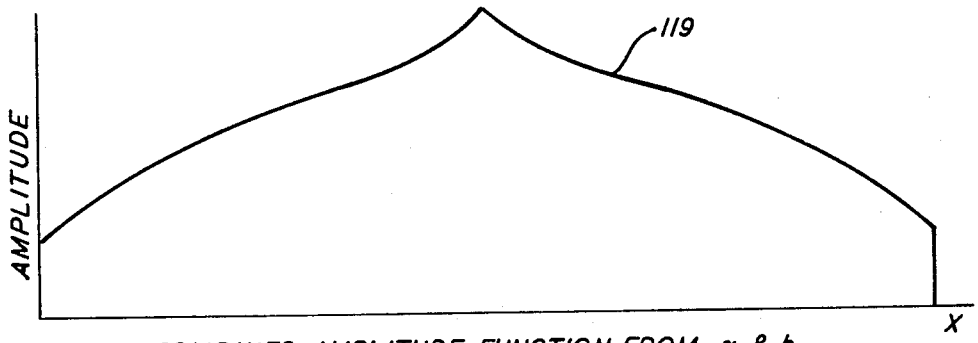

FIG. 15 illustrates the correspondence between feed ports and beam quandrant and is self-explanatory. As explained above in connection with FIGS. 12 and 13, the use of forward and backward travelling wave radiating arrays has the effect of making the composite beam independent of frequency and temperature effects. To repeat what was noted above, when tne frequency or temperature changes from normal, the two beams will move in opposite directions making the composite beam maintain its original direction although the beam will be broadened. The use of forward and backward firing arrays also adds considerably to the aperture efficiency of the antenna, reducing beam width and increasing gain. This is illustrated by FIGS. 16*a–c* which gives the amplitude distributions for the forward and backward firing arrays, and the composite amplitude function. Thus, in FIG. 3*a* the amplitude function 115 of the forward firing array fed from the left is shown. On FIG. 3*b* the amplitude function 117 of the backward firing array fed from the right is shown. Finally, on FIG. 3*c* the combined amplitude function 119 obtained by adding the functions of FIGS. 3*a* and 3*b* is shown. The composite amplitude function 119 created by the two sets of arrays together is symmetrical in nature. This type of an amplitude pattern is superior to any asymmetrical amplitude function in terms of beam width, gain and side lobe level.

Figure 17:
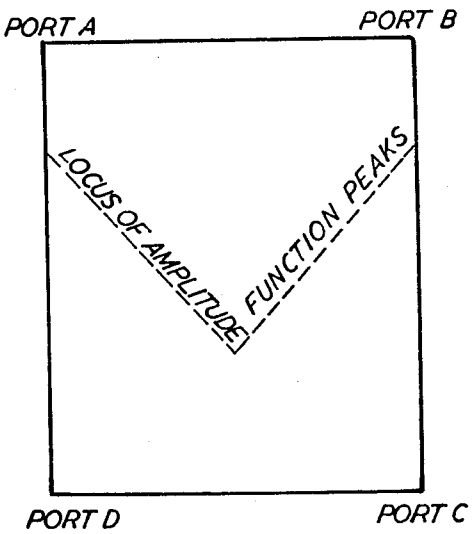
FIG. 17 illustrates the amplitude distribution geometry on the two dimensional apertures of FIG. 14.
Figure 18:
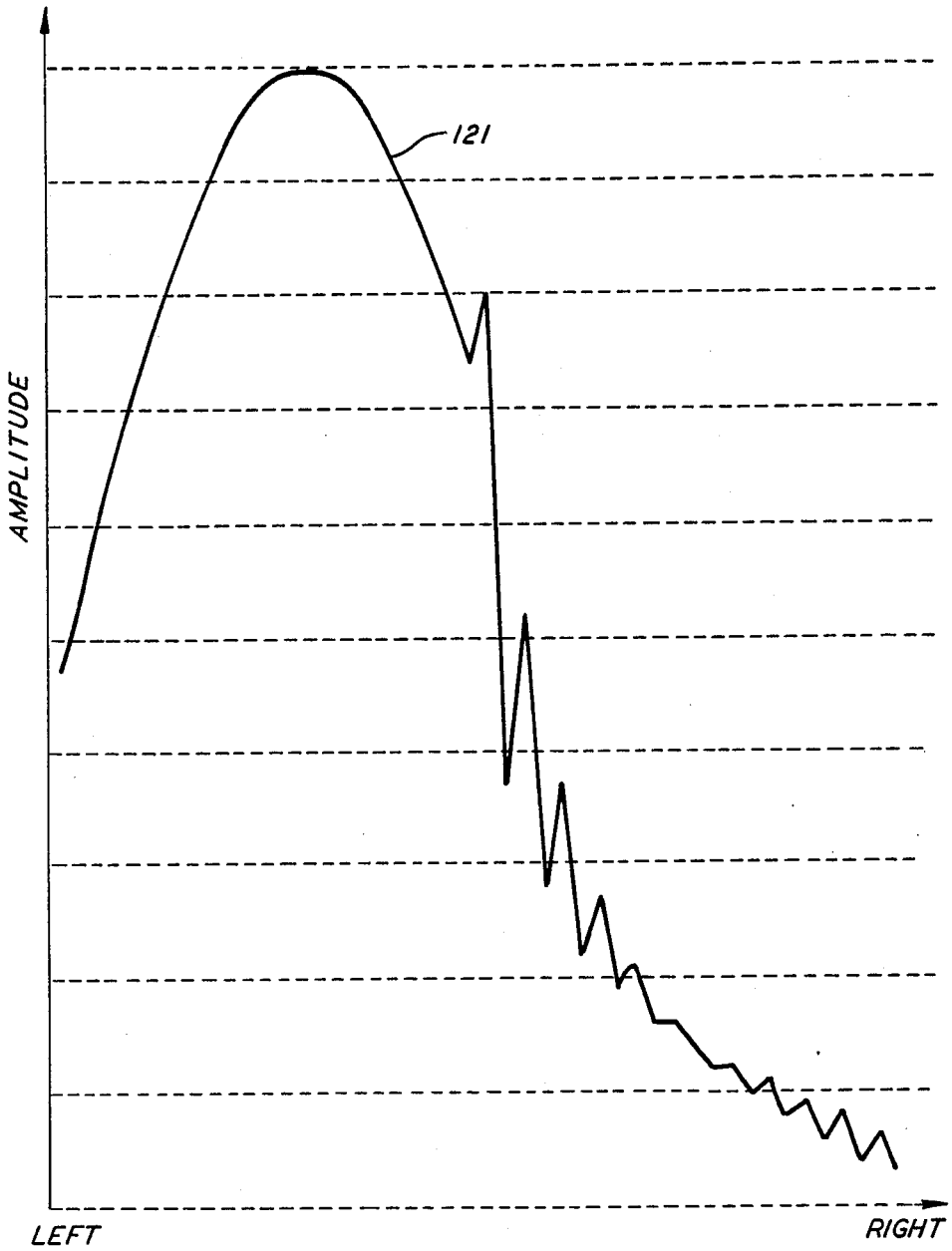
FIGS. 18 and 19 illustrate calculated amplitude functions of the antenna of FIG. 14.
Figure 19:
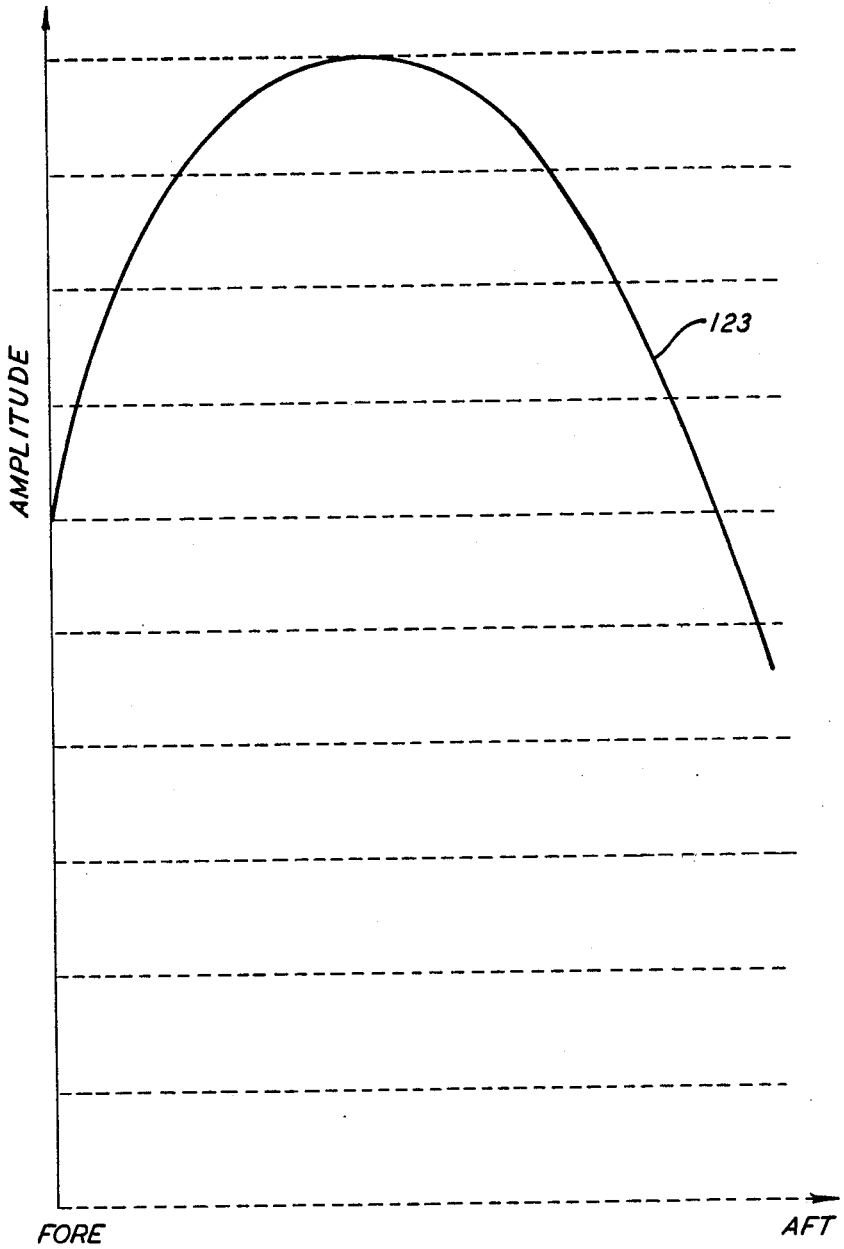

Beam shaping is accomplished using the techniques described above in connection with FIGS. 6–10 by designing the conductances of the radiating array such that the amplitude distribution on the aperture is slanted. FIG. 17 shows a typical locus of amplitude function peaks when fed from port A. It should be noted that the left half of the aperture of FIG. 5 has an amplitude slant that decreases terrain dependence while the right half has a slant which increases terrain dependence. The left side half dominates the beam shaping by virtue of feeding unequal power to the two halfs. The right half receives only about 10% of the transmitter power. This is accomplished using known design techniques in designing the feed array. The typical feed array axis amplitude distribution is shown in FIG. 18. As is evident, the amplitude function 121 is maximized on the left and minimized on the right. A corresponding amplitude function for the composite radiating array, summed across the antenna, is shown by the curve 123 of FIG. 19.

Figure 20:
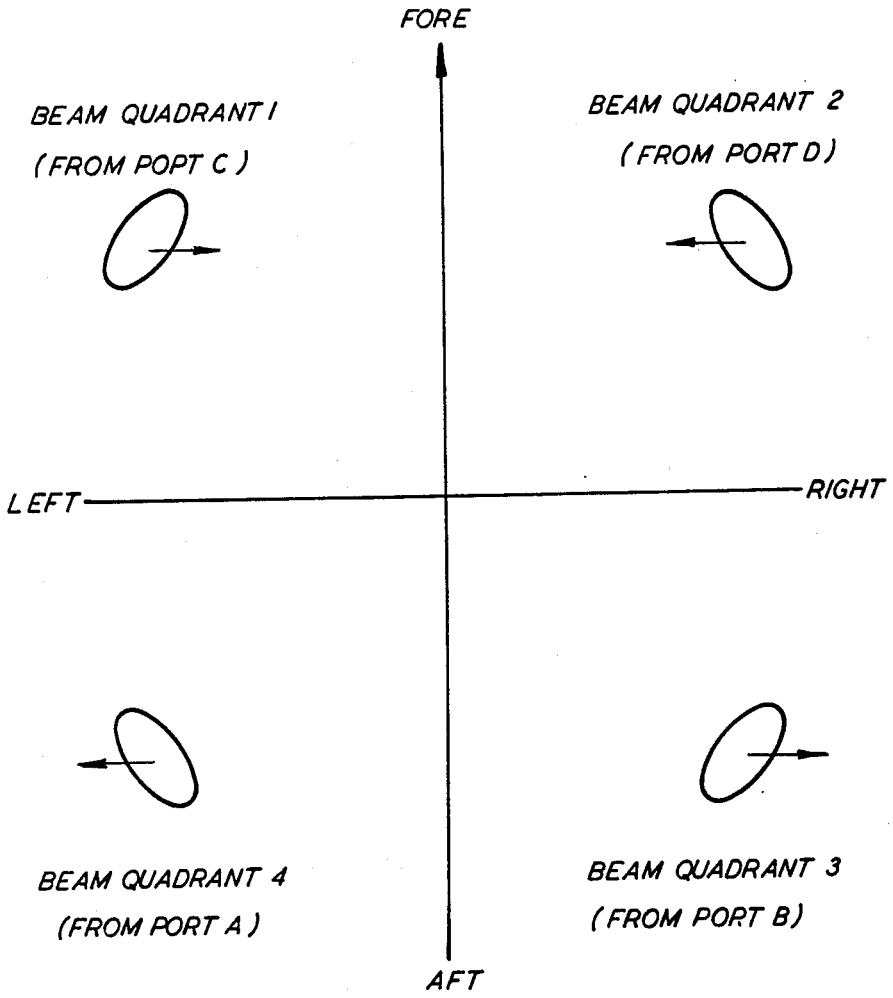
FIG. 20 shows the movement of the beam footprints of the antenna of FIG. 14 with increasing frequency.

Frequency and temperature compensation of the sigma angles is accomplished through the use of the forward firing array 109 of FIG. 14 between ports A and B and backward firing feed array 111 between ports C and D. The footprints of the beams on the ground is illustrated on FIG. 20 along with their beam swing directions with increasing frequency. It can be seen that as frequency increases, the angle included between the two beams from ports C and D will decrease, whereas, the angle included between the ports A and B will increase. The overall effect of this is, that when the information from all beams in processed, the two pair motions will cancel each other with no impact on velocity, cross coupling coefficients.

Figure 21:
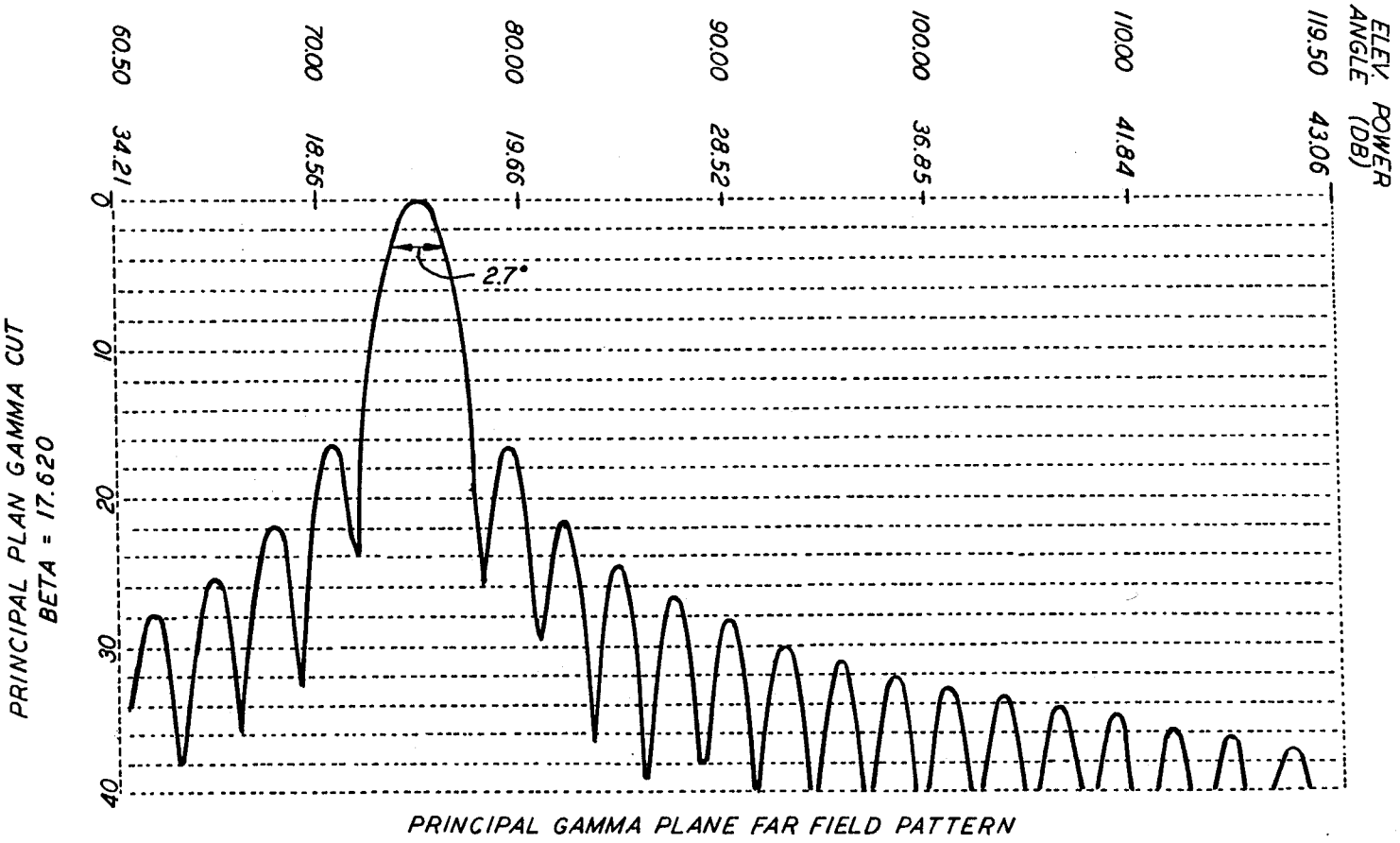
FIGS. 21 and 22 show the far field patterns of the antenna of FIG. 14.
Figure 22:
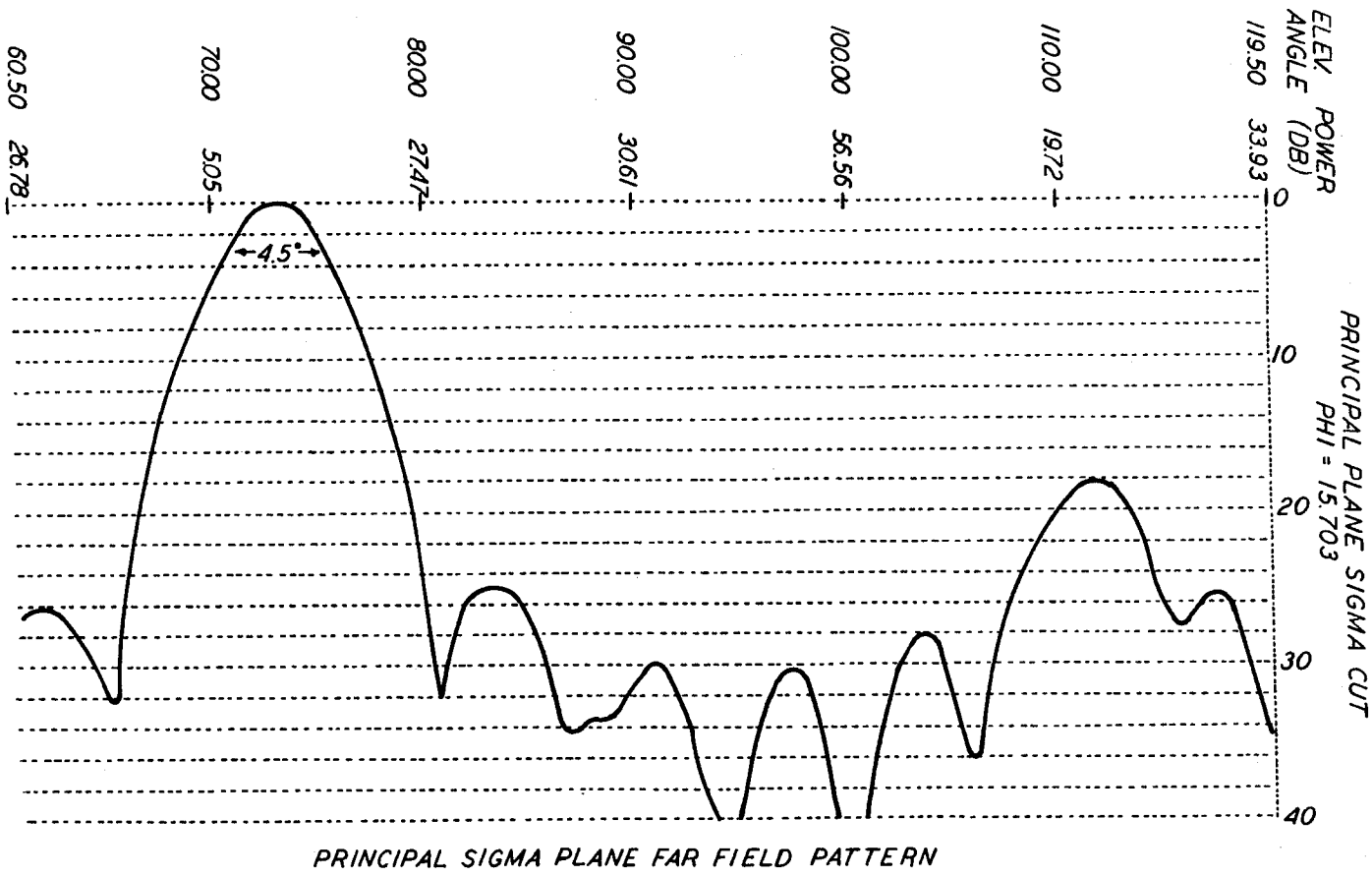
Figure 23:
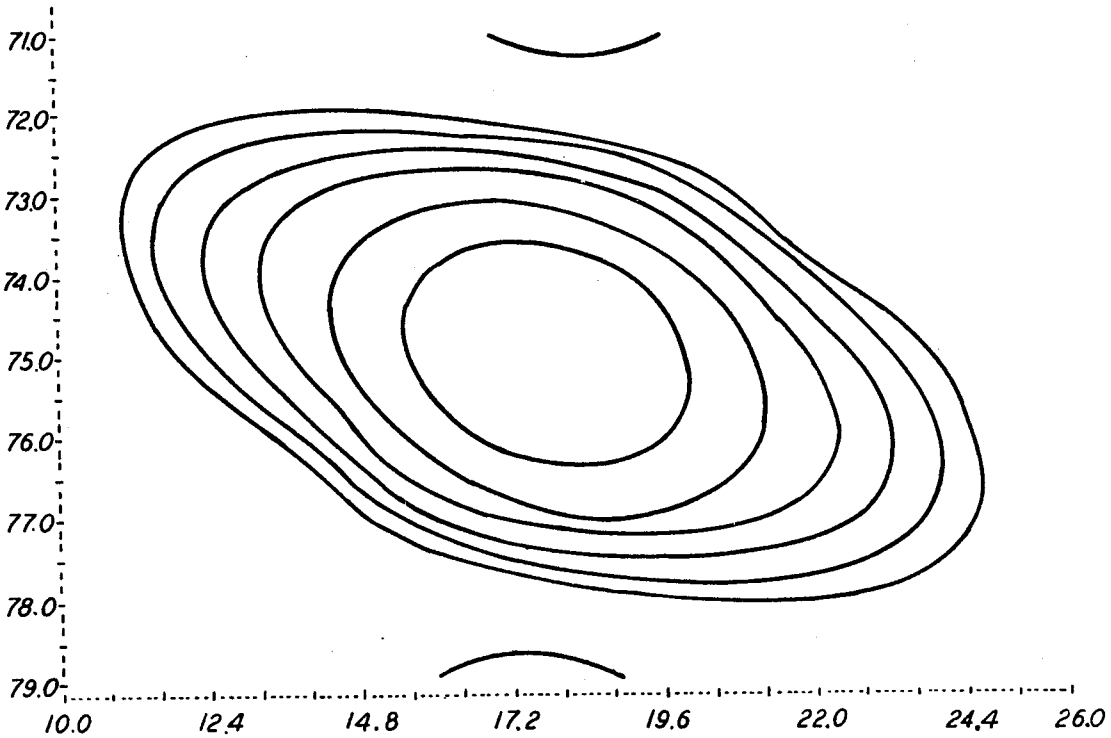
FIG. 23 shows the beam contours of the antenna of FIG. 14.

The antenna of FIG. 14 was moldeled on a computer. The computer patterns for principal plane cuts are shown in FIG. 21 and 22, with FIG. 21 showing the principal gamma plane far field pattern and FIG. 22 the principal sigma plane far field pattern. A two-dimensional main beam contour map showing the shaped beam is presented in FIG. 23.

Finally, although the antenna can be implemented using a variety of transmission lines and radiating devices, at present, the best mode of implementation is considered to be microstrip lines and radiating patches. Such a configuration is shown on FIG. 24. In this configuration, the sizes of the patches, determining the coupling coefficient thereof, and the length of the connecting line segments is related to the beam steering angle, i.e., whether or not it is forward or backward firing. Thus, as illustrated, each of the arrays 105 and 107 is made up of a plurality of interconnected patches 131. The patches are interconnected by transmission lines 133. As illustrated, the interconnected in the forward firing array has a greater length than the corresponding interconnection in the backward firing array. This is also evident from an examination of the forward firing feed array 109 and the backward firing feed array 111. The manner in which such a construction can be used to control beam steering angle is described in more detail in the aforementioned U.S. Pat. No. 4,180,818. Furthermore, on this figure, observance of the patch size will show that the amplitude locus shown in FIG. 17 is present.

Figure 24:
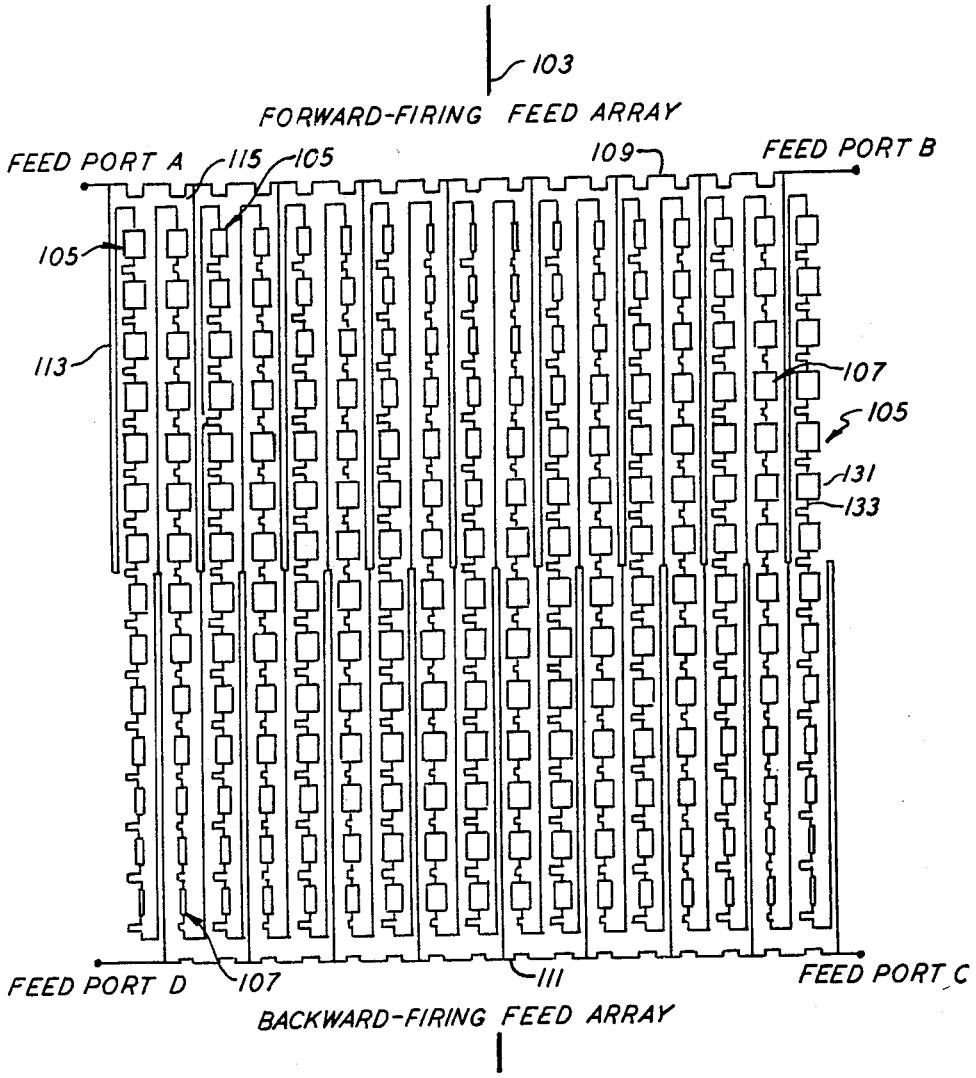
FIG. 24 shows a micro-strip implementation of the antenna of FIG. 14.

The antenna of FIGS. 14 and 24 is distinguished from the previous antennas discussed, in particular, in that, by interweaving, in addition to obtaining frequency and temperature compensation in a single beam, rather than in pair of beams, the apperture efficiency is greatly increased because of the symmetrical nature of the combined amplitude function as discussed above in connection with FIGS. 16*a–c*. This technique is applicable not only to a doppler antenna of the type described in FIGS. 14 and 24, but is generally applicable to any situation where a linear array is used to generate two beams by feeding from opposite ends. In some cases, this might be done with a single array as opposed to the plurality of arrays shown on FIGS. 14 and 24. In accordance with the present invention greatly improved results are obtained by using a pair of arrays, one forward firing and one backward firing. When feeding from one port the forward firing array is fed from its other end and the backward firing array from the same end as the forward firing array was fed when being fed from the first port. This then results in the type of amplitude function shown on FIG. 16*c*.

Figure 25:
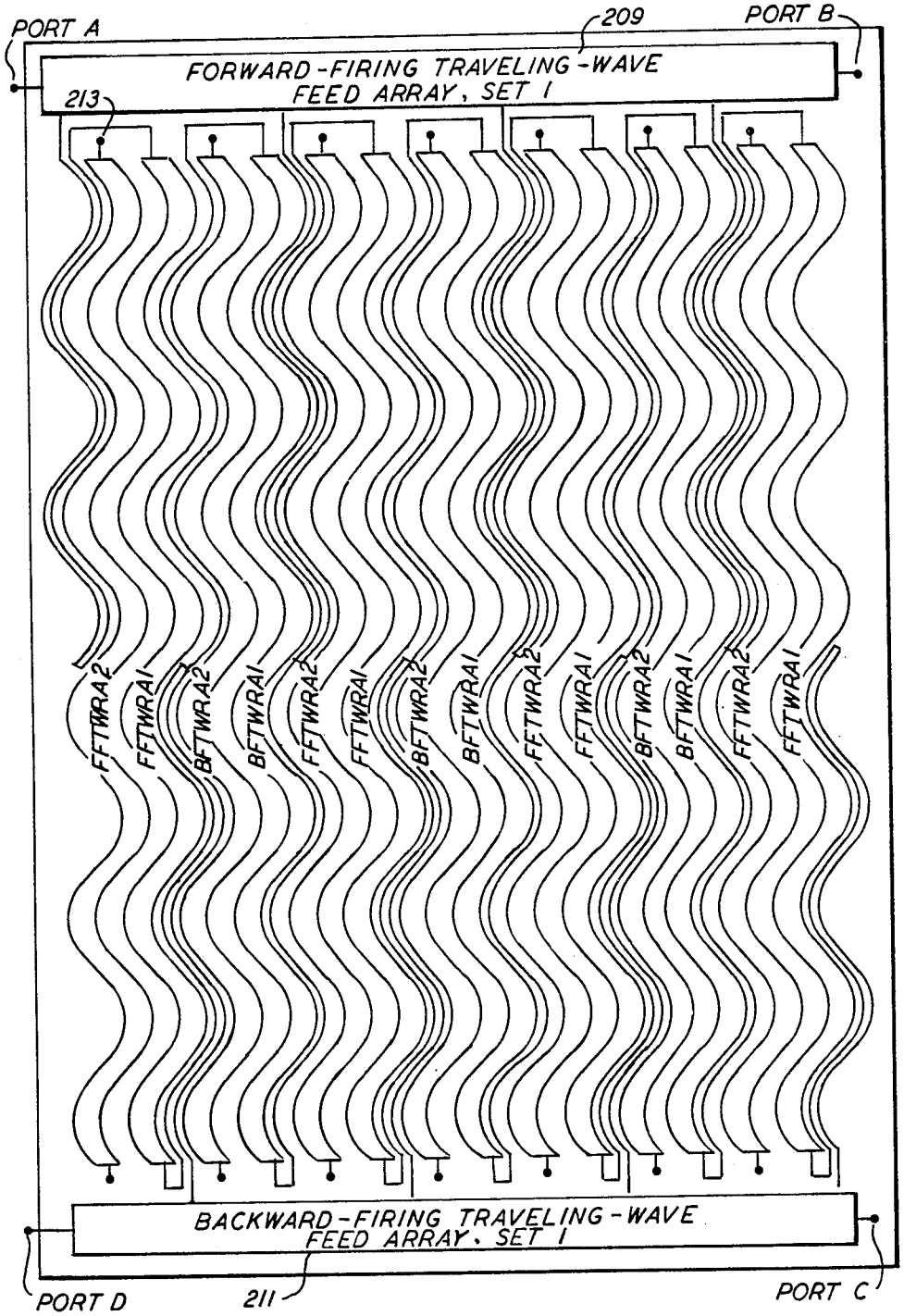
FIG. 25 is a plan-schematic view of an eight beam single aperture antenna, showing one set of feed arrays.
Figure 26:
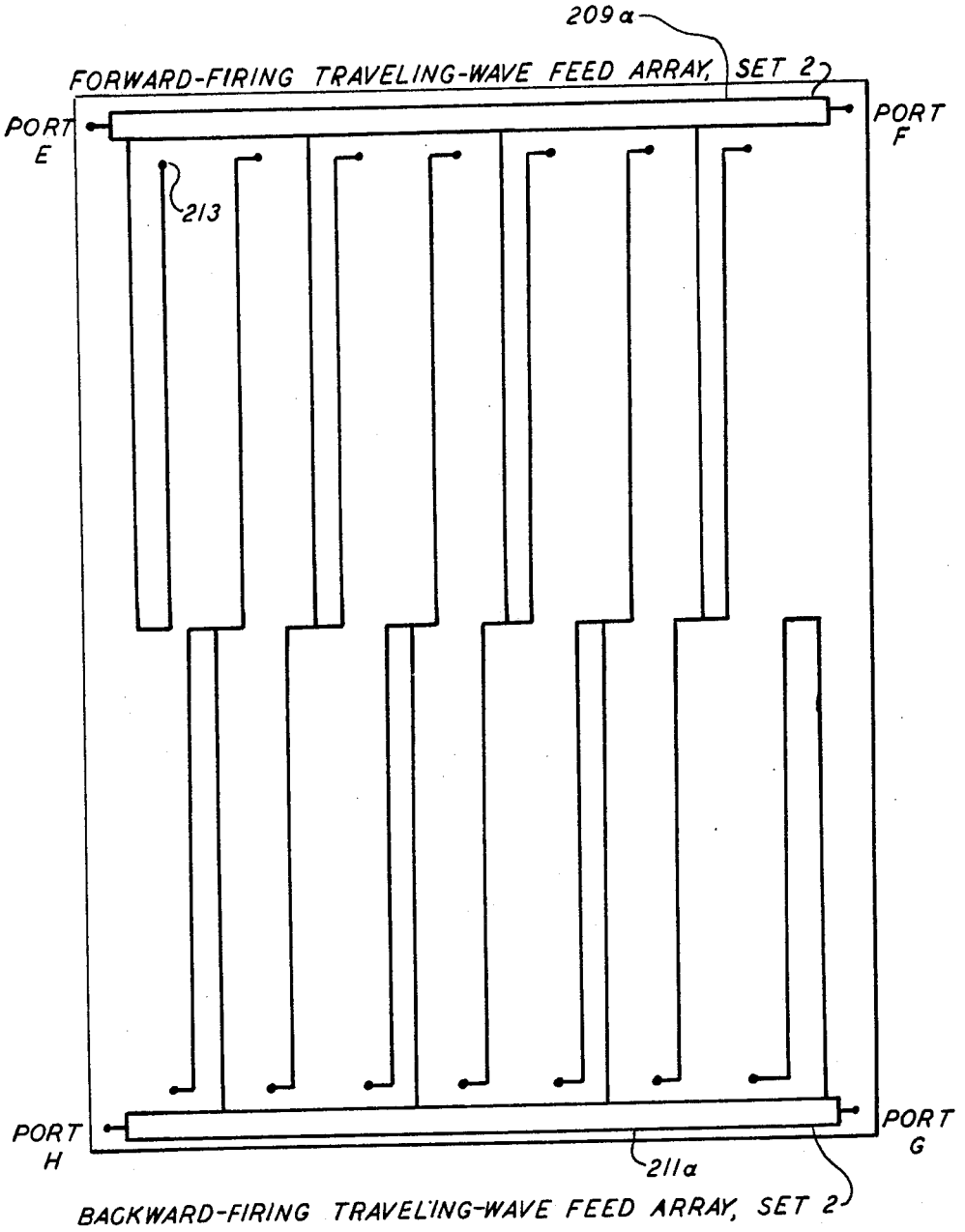
FIG. 26 is a plan view of the second level of feed arrays for the antenna of FIG. 25.

Illustrated on FIG. 25 is an antenna which is capable of generating eight beams from a single aperture. This is accomplished by interlacing two compete sets of radiating arrays together. Each of the radiating arrays comprises alternating forward and backward firing arrays. Thus, with reference to FIG. 25 there is shown a forward firing travelling wave array belonging to the first set of arrays and designated FFTWRA 1. Directly adjacent to it is a forward firing array from the other set designated FFTWRA 2. Following these are backward firing arrays from each of the two sets designated respectively BFTWRA 1 and BFTWRA 2. The pattern is repeated across the antenna. Each radiating array follows a serpentine path. Set 1 of the radiating arrays is fed by a forward feed array 211. These correspond essentially to the feed arrays 109 and 111 of FIG. 14. The feed arrays for the second set are shown on FIG. 26 and, again, there is a forward firing travelling feed array 209*a* and a backward firing travelling feed array 211*a*. In an embodiment of the invention utilizing microstrip transmission lines and patches corresponding to the four beam array of FIG. 24, the feed arrays 209 and 211 will be disposed on the same level as the radiating arrays and the feed arrays 209*a* and 211*a* on a level below and connected to the corresponding radiating arrays through feed-throughs 213 shown on both FIGS. 14 and 24. Thus, as in that embodiment, by using the forward and backward radiating arrays a composite beam which is independent of frequency and temperature effects is obtained. Similarly, frequency and temperature compensation along the transverse axis is obtained in the manner described above in connection with FIG. 20. Again, as in the previous embodiment, and as illustrated by FIGS. 16*a, b* and *c*, a combined amplitude function which increases aperture efficiency, reduces bandwidth and increased gain will result. Again, as before the amplitude function is symmetrical as shown in FIG. 17.

Figure 6A:
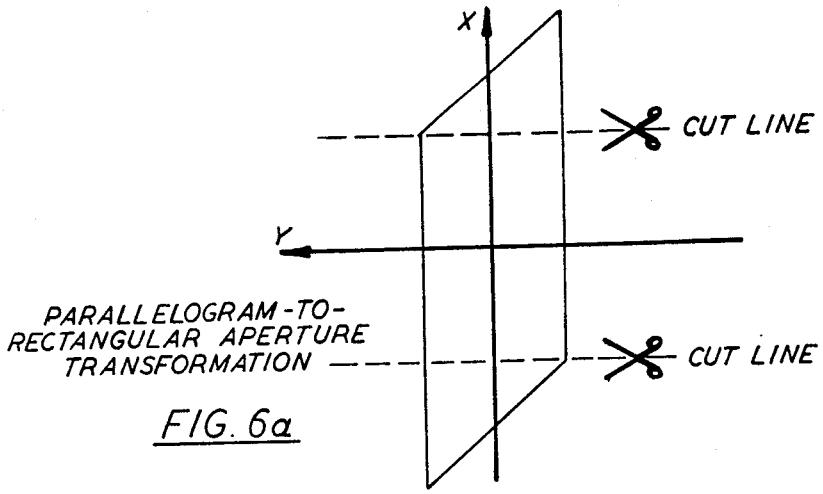
FIG. 6*a* shows the truncation of a long slanted array into a rectangular array.
Figure 6B:
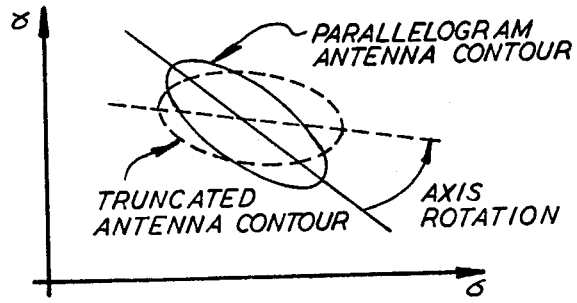
FIG. 6*b* shows the contour rotation effects resulting from the truncation of FIG. 6*a*.
Figure 27A:
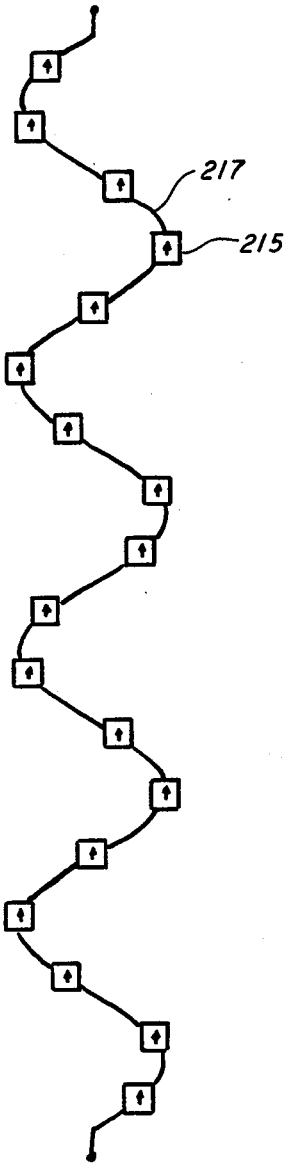
FIG. 27*a* and 27*b* show the type of vertically and horizontally polarized arrays which may be used in the antenna of FIG. 25.
Figure 27B:
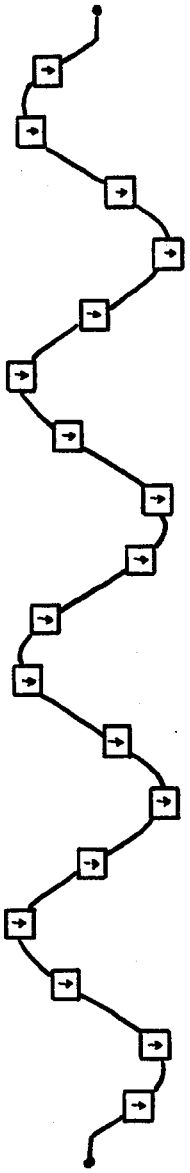

The purpose of the serpentine radiating array geometry is to suppress any grating beams which would exist if linear arrays were used with the large separation needed to accommodate two complete interlaced sets. The polarization alignment of the radiating arrays will be maintained over the entire array as shown by FIGS. 27*a* and *b*. Shown thereon are the radiating patches 215 with their interconnecting transmission lines 217 arranged in serpentine fashion. FIG. 6*a* shows a vertically polarized arrangement and 6*b* a horizontally polarized arrangement.

Beam shaping is accomplished in the same manner described above. In other words, each of the sets of arrays will have an amplitude function as shown in FIG. 10 and obtained in the same manner discussed in connection therewith. Furthermore, the same feeding arrangement in which, when fed, for example, from port A or from port E, the left side half will dominate the beam shaping by virtue of unequal power distribution, the right half receiving only about 10% of the transmitted power, will be utilized.

Figure 28:
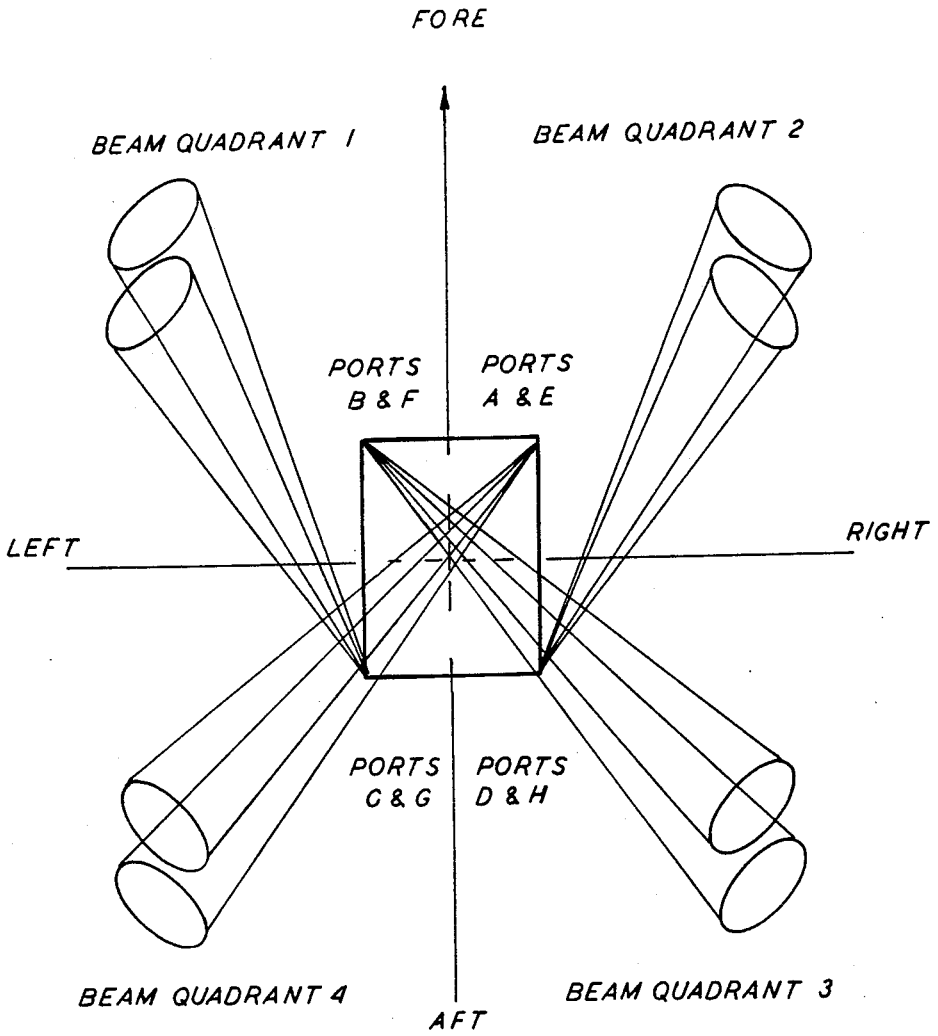
FIG. 28 illustrates the feed port to beam direction correspondence of the antenna of FIG. 25.
Figure 29A:
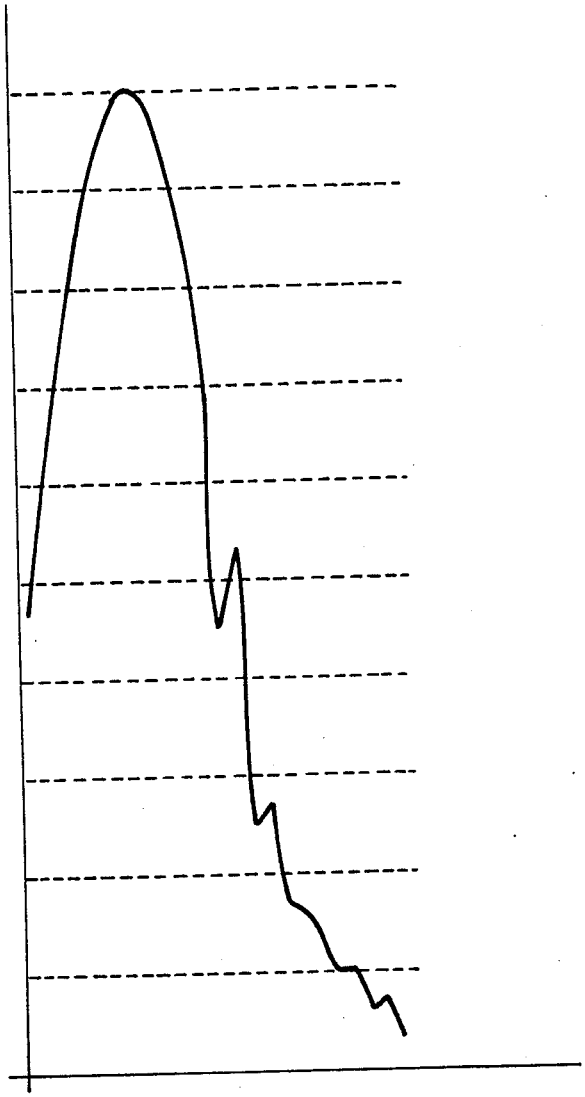
FIGS. 29*a* and 29*b* illustrate calculated amplitude functions of the antenna of FIG. 25.
Figure 29B:
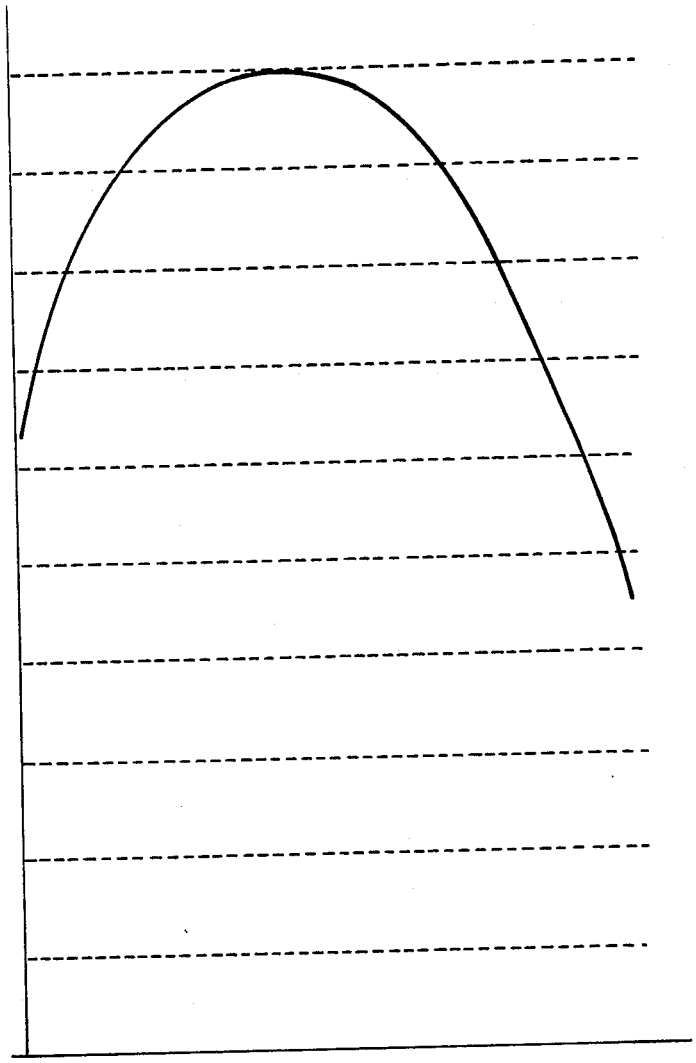
Figure 30:
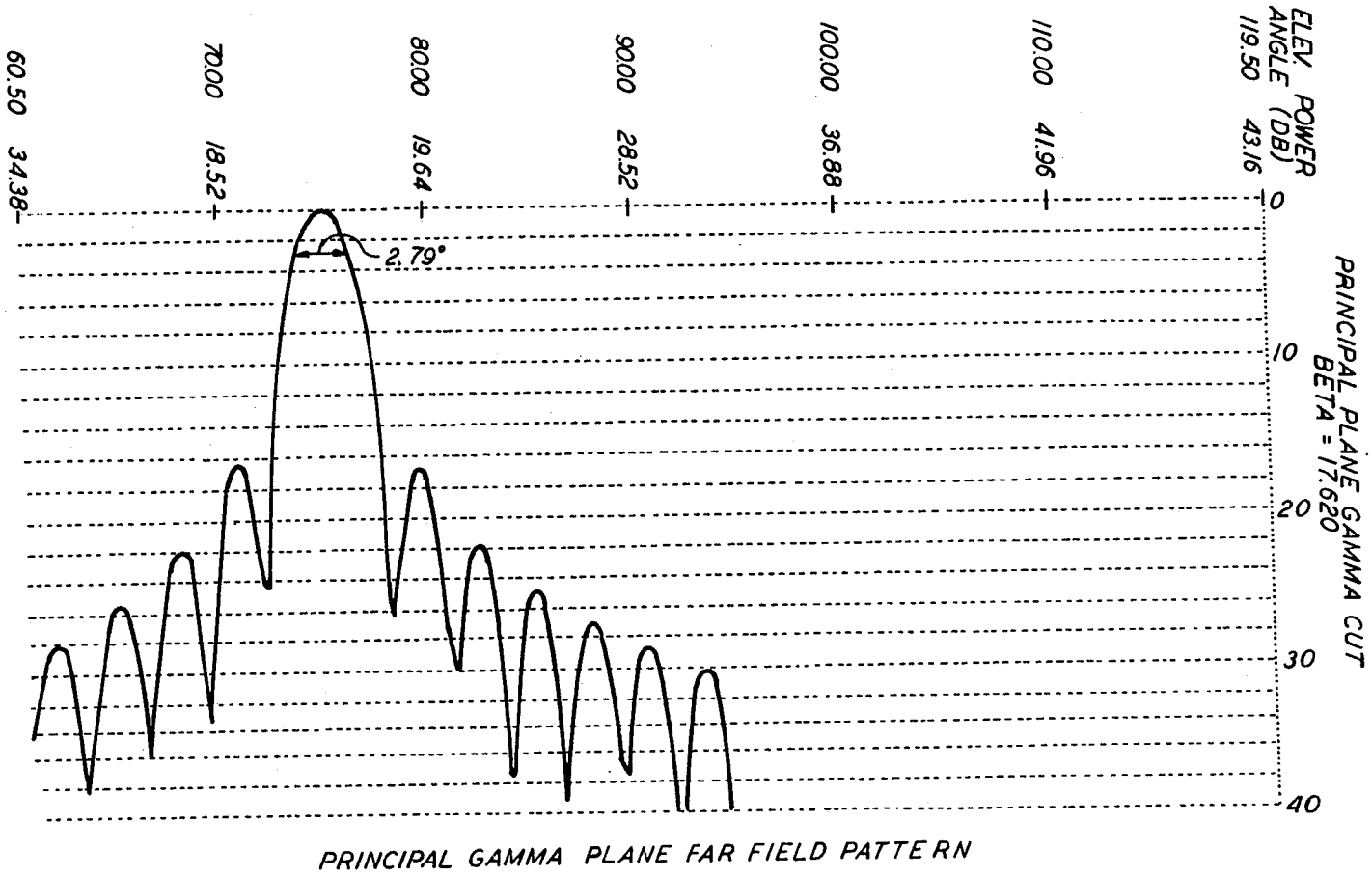
FIGS. 30 and 31 show the far field patterns of the antenna of FIG. 25.
Figure 31:
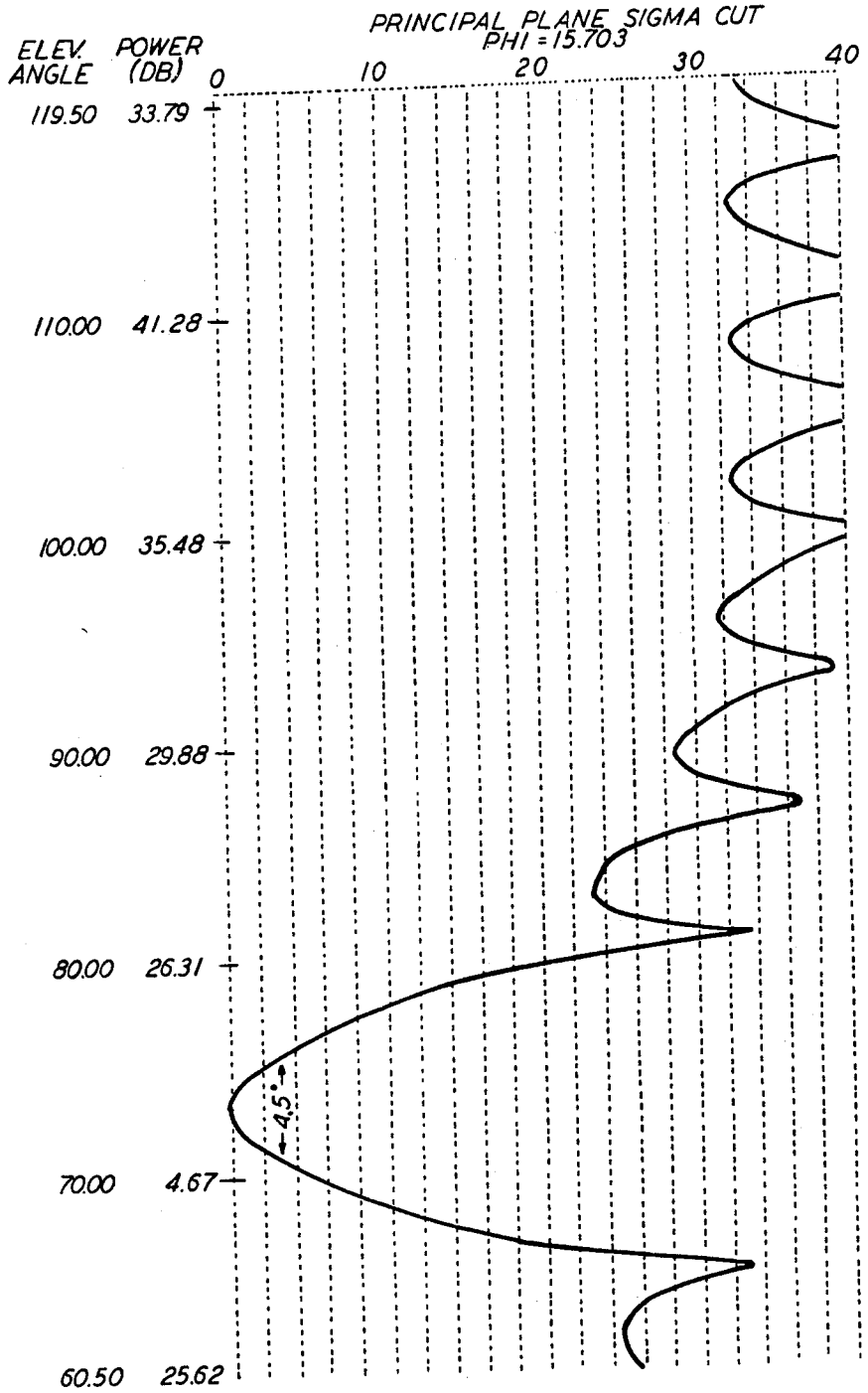
Figure 32:
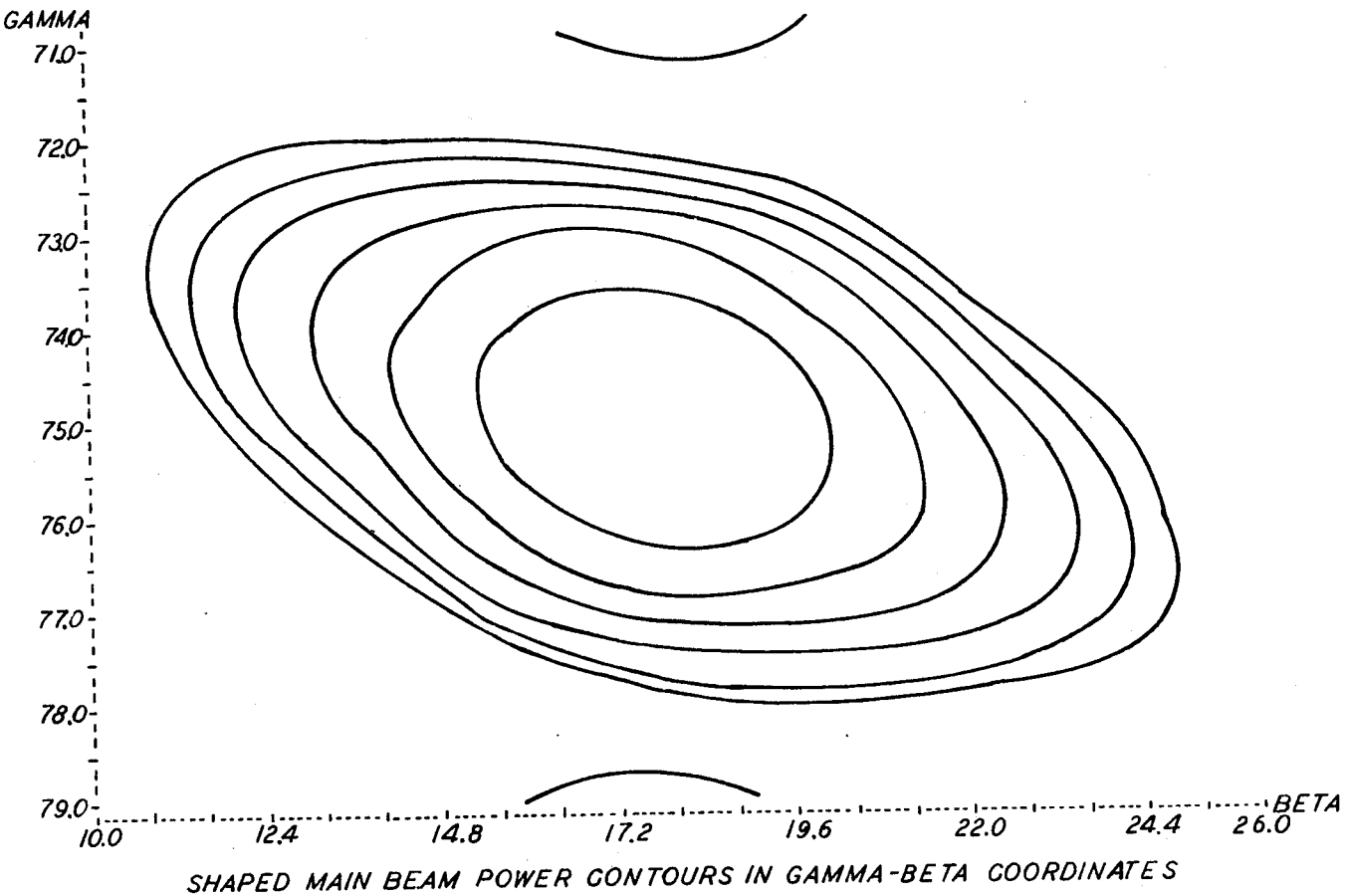
FIG. 32 shows the beam contours of the antenna of FIG. 25.

FIG. 28 illustrates the correspondence between beam direction and the ports which are fed and is self-explanatory. The corresponding amplitude functions in the plane of the feed array and the amplitude function in the plane of the radiating arrays summed across the aperture when fed from either port A or E are shown respectively on FIGS. 29*a* and 29*b*. Again, this antenna was molded on a computer and the corresponding principal gamma plane far field pattern, principal sigma plane far field pattern, and shaped main beam contours in gamma-beta coordinates are shown respectively on FIGS. 30, 31 and 32.

The use of two completely independent arrays in the same aperture creates a parameter switchable antenna in which the following differences may be provided between set 1 and set 2: (1) gamma angles; (2) sigma angles; (3) both gamma and sigma angles; (4) orthogonal polarization with no angular variation; and (5) orthogonal polarization with angular variations.

The antenna of the present invention also has potential usage in a FM-CW doppler system in which the two sets will have the same perimeters and act as two spaced duplex antennas, one for transmitting and the other for receiving.

Below, listed in Table I is a comparison of antenna parameters giving the respective parameters for a simple rectangular antenna, a printed gridded antenna, the dual apeture antenna of FIG. 11, the single aperture four beam antenna of FIGS. 14 and 24, and the single aperture eight beam antenna of FIG. 25. All of these antennas operate at 13,325 gHz and have aperture dimensions of 20" by 16". All except the single aperture eight beam antenna produce four beams. The most important advantage of the two single aperture antennas with respect to the others is the reduction in beam width, which in doppler navigation applications has a direct effect in improving signal to noise ratio by compressing the spectrum of the return signal. This improved performance will permit extended altitude and speed ranges for doppler navigations systems with which it is used. In addition it will improve accuracy with the narrower spectrum signal by reducing the fluctuation. The narrower sigma band widths also have a direct effect on reducing terrain dependence in the transverse axis velocity measurement, since the beam shaping does not compensate for this axis.

| Parameter | Simple Rectangular | Printed Grid | Dual Aperture | Single Aperture 4 beam | Single Aperture, 8-beam |
|---|---|---|---|---|---|
| Directive Gain | 32 dB | 32.5 dB | 30.5 dB | 34 dB | 34 dB |
| Gamma Beamwidth | 3.6° | 3.7° | 3.3° | 2.7° | 2.7° |
| Sigma Beamwidth | 5.8° | 6.2° | 6.7° | 4.5° | 4.5° |
| Sidelobes | 20 dB | 23 dB | 20 dB | 22 dB | 22 dB |
| Image Beams | 20 dB | 16 dB | 20 dB | 21 dB | 21 dB |
| Grating Lobes | none | none | none | none | 20 dB |
| Overwater | 1% | .3% | .1% | .2% | .2% |

-continued

| Parameter | Simple Rectangular | Printed Grid | Dual Aperture | Single Aperture 4 beam | Single Aperture, 8-beam |
|---|---|---|---|---|---|
| KXX Shift Overwater Kyy Shift | 2.5% | 2.5% | 3% | 1.5% | 1.5% |

I claim:

1. A rectangular antenna aperture for Doppler navigation systems aligned along the direction of travel of an aircraft and consisting of a series of parallel arrays of radiating elements coupled to feed means, and having the radiating coefficients of said radiating elements and the coupling coefficients of said arrays to said feed means adjusted so that the amplitude function of said aperture along the axis of travel is a truncation of a long slanted array amplitude function, comprising:

(a) a single rectangular aperture;

(b) first and second forward-firing traveling feed arrays disposed along one end of said aperture;

(c) first and second backward-firing traveling wave feed arrays arranged along the opposite end of said aperture, each of said traveling wave feed arrays having two input ports;

(d) a first set of forward-firing traveling wave radiating arrays extending between said feed arrays in spaced relationship with each other, each of said first set of forward-firing traveling wave radiating arrays having one end coupled to said first forward-firing traveling wave feed array and another end coupled to said first backward-firing traveling wave feed array;

(e) a first set of backward-firing traveling wave radiating arrays disposed in the spaces between said first set of forward-firing traveling wave radiating arrays such that said first set of forward and said first set of backward arrays alternate with each other, each of said backward-firing traveling wave radiating arrays having their one end coupled to said first forward-firing traveling wave feed array and their other end coupled to said first backward-firing traveling wave feed array;

(f) a second set of forward-firing traveling wave radiating arrays, one such array being disposed adjacent each of said first set of forward-firing traveling wave radiating arrays;

(g) a second set of backward-firing traveling wave radiating arrays one being disposed next to each of said first set of backward-firing traveling wave radiating arrays, each of the arrays of the said second sets of forward and backward-firing traveling wave radiating arrays having one end coupled to said second forward-firing traveling wave feed array and their other end coupled to said second backward firing traveling wave feed array, whereby with a single aperture eight separate beams can be generated.

2. The antenna of claim 1, wherein each of the said radiating arrays extending between said feed arrays follows a serpentine path.

3. The antenna according to claim 2 wherein adjacent radiating arrays in said antenna have opposite directions of polarization.

4. An antenna according to claim 3, wherein said radiating arrays are implemented utilizing microstrip patches.

5. An antenna comprising:

(a) a single rectangular aperture;

(b) first and second forward-firing traveling feed arrays disposed along one end of said aperture;

(c) first and second backward-firing traveling wave feed arrays arranged along the opposite end of said aperture, each of said traveling wave feed arrays having two input ports;

(d) a first set of forward-firing traveling wave radiating arrays extending between said feed arrays in spaced relationship with each other, each of said first set of forward-firing traveling wave radiating arrays having one end coupled to said first forward-firing traveling wave feed array and another end coupled to said first backward-firing traveling wave feed array;

(e) a first set of backward-firing traveling wave radiating arrays disposed in the spaces between said first set of forward-firing traveling wave radiating arrays such that said first set of forward and said first set of backward arrays alternate with each other, each of said backward-firing traveling wave radiating arrays having one end coupled to said first forward-firing traveling end coupled to said first forward-firing traveling wave feed array and their other end coupled to said backward first backward-firing traveling wave feed array;

(f) a second set of forward-firing traveling wave radiating arrays one such array being disposed adjacent each of said first set of forward-firing traveling wave radiating arrays;

(g) a second set of backward-firing traveling wave radiating arrays one being disposed next to each of said first set of backward-firing traveling wave radiating arrays, each of the arrays of the said second sets of forward and backward-firing traveling wave radiating arrays having one end coupled to said second forward-firing traveling wave feed array and their other end coupled to said second backward firing traveling wave feed array, whereby with a single aperture eight separate beams can be generated.

6. The antenna of claim 5, wherein each of the said radiating arrays extending between said feed arrays follows a serpentine path.

7. The antenna according to claim 6 wherein adjacent radiating arrays in said antenna have opposite directions of polarization.

8. An antenna according to claim 7, wherein said radiating arrays are implemented utilizing microstrip patches.

* * * * *